US009966059B1

(12) United States Patent
Ayrapetian et al.

(10) Patent No.: US 9,966,059 B1
(45) Date of Patent: May 8, 2018

(54) RECONFIGURALE FIXED BEAM FORMER USING GIVEN MICROPHONE ARRAY

(71) Applicant: Amazon Technologies, Inc., Seattle, WA (US)

(72) Inventors: Robert Ayrapetian, Morgan Hill, CA (US); Philip Ryan Hilmes, Sunnyvale, CA (US); Carlo Murgia, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days. days.

(21) Appl. No.: 15/697,088

(22) Filed: Sep. 6, 2017

(51) Int. Cl.

| | |
|---|---|
| ***G10K 11/178*** | (2006.01) |
| ***G10L 21/0216*** | (2013.01) |
| ***H04R 1/08*** | (2006.01) |
| ***H04R 1/32*** | (2006.01) |
| ***H04R 1/46*** | (2006.01) |
| ***H04R 3/00*** | (2006.01) |

(52) U.S. Cl.
CPC ..... *G10K 11/178* (2013.01); *G10L 21/0216* (2013.01); *H04R 1/08* (2013.01); *H04R 1/32* (2013.01); *H04R 1/46* (2013.01); *H04R 3/002* (2013.01)

(58) Field of Classification Search
CPC .... G10K 11/178; G10L 21/0216; H04R 1/08; H04R 1/32; H04R 1/46; H04R 3/002
USPC ..... 381/92
See application file for complete search history.

(56) References Cited

U.S. PATENT DOCUMENTS

| | | | | |
|---|---|---|---|---|
| 9,432,769 | B1 * | 8/2016 | Sundaram | H04R 3/005 |
| 9,747,920 | B2 * | 8/2017 | Ayrapetian | G10L 21/0216 |
| 9,818,425 | B1 * | 11/2017 | Ayrapetian | G10L 21/0224 |
| 2008/0312918 | A1 * | 12/2008 | Kim | G10L 15/01 704/233 |
| 2009/0304203 | A1 * | 12/2009 | Haykin | G10L 21/02 381/94.1 |
| 2013/0073283 | A1 * | 3/2013 | Yamabe | G10L 21/0216 704/226 |
| 2014/0126745 | A1 * | 5/2014 | Dickins | H04R 3/002 381/94.3 |
| 2015/0149164 | A1 * | 5/2015 | Oh | H04R 3/005 704/231 |

* cited by examiner

*Primary Examiner* — David Ton
(74) *Attorney, Agent, or Firm* — Pierce Atwood LLP

(57) ABSTRACT

An acoustic interference cancellation system that performs beamforming using a subset of microphones from a microphone array. For example, a first group of microphones from an array can be used to generate target signals that focus on the direction of the desired speech in the audio and a second group of microphones from the array can be used to generate reference signals that include the environmental noise, audio from a loudspeaker, etc. The reference signals of the second group of microphones can then be used to isolate the actual speech from the target signals of the first group of microphones. The microphone array can be three dimensional, allowing a device to simplify beamforming calculations by selecting subsets of microphones along different planes. In addition, directional microphones and remote microphones may be used to improve a quality of the reference signals.

20 Claims, 15 Drawing Sheets

RECONFIGURALE FIXED BEAM FORMER USING GIVEN MICROPHONE ARRAY

BACKGROUND

In audio systems, beamforming refers to techniques that are used to isolate audio from a particular direction. Beamforming may be particularly useful when filtering out noise from non-desired directions. Beamforming may be used for various tasks, including isolating voice commands to be executed by a speech-processing system.

BRIEF DESCRIPTION OF DRAWINGS

For a more complete understanding of the present disclosure, reference is now made to the following description taken in conjunction with the accompanying drawings.

DETAILED DESCRIPTION

Beamforming systems isolate audio from a particular direction in a multi-directional audio capture system. One technique for beamforming involves boosting audio received from a desired direction while dampening audio received from a non-desired direction. In one example of a beamformer system, a fixed beamformer employs a filter-and-sum structure, as explained below, to boost an audio signal that originates from the desired direction (sometimes referred to as the look-direction) while largely attenuating audio signals that originate from other directions. A fixed beamformer may effectively eliminate certain noise (e.g., undesirable audio), which is detectable in similar energies from various directions (called diffuse noise), but may be less effective in eliminating noise emanating from a single source in a particular non-desired direction (called coherent noise).

To improve the isolation of desired audio while also removing coherent, directional-specific noise, a beamforming component can incorporates not only a fixed beamformer to cancel diffuse noise, but also an adaptive beamformer/noise canceller that can adaptively cancel noise from different directions depending on audio conditions. An adaptive beamformer may provide significant improvement in the overall signal-to-noise ratio (SNR) under noisy conditions. However, under quiet conditions, i.e., at a high SNR, the adaptive beamformer may tend toward distortion of a desired audio signal and may result in inferior performance when compared to the fixed beamformer.

Typically, beamforming is done using an entirety of audio data generated by a microphone array. Thus, the beamforming generates multiple beams corresponding to different directions, with some beams selected as target signals and some beams selected as reference signals.

To improve beamforming, the present system performs beamforming using a subset of microphones from a microphone array. For example, a first group of microphones from an array can be used to generate target signals that focus on the direction of the desired speech in the audio and a second group of microphones from the array can be used to generate reference signals that include the environmental noise, audio from a loudspeaker, etc. The reference signals of the second group of microphones can then be used to isolate the actual speech from the target signals of the first group of microphones. The microphone array can be three dimensional, allowing a device to simplify beamforming calculations by selecting subsets of microphones along different planes. In addition, directional microphones and remote microphones may be used to improve a quality of the reference signals.

Figure 1A:
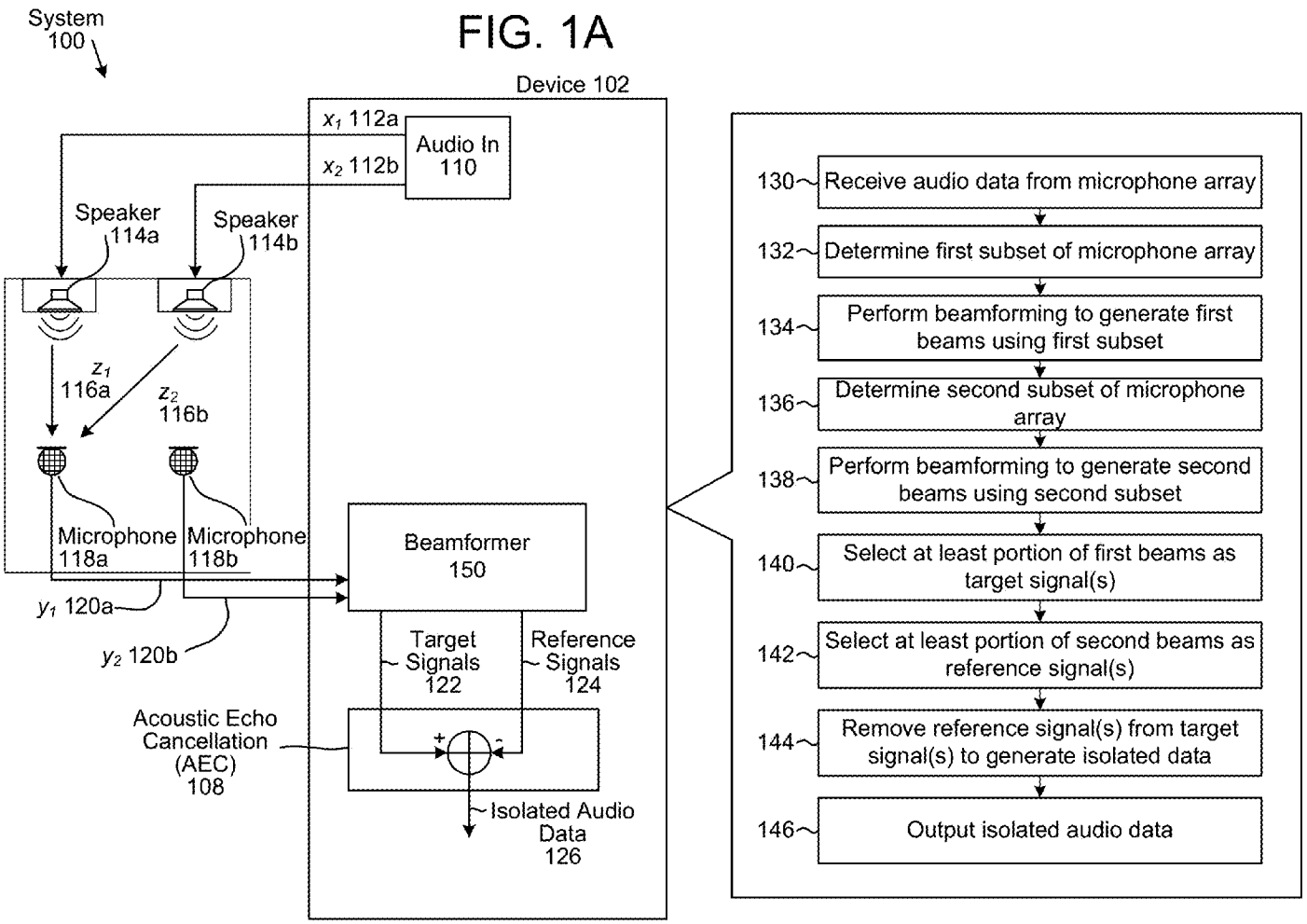
FIGS. 1A-1B illustrate acoustic interference cancellation systems according to embodiments of the present disclosure.

FIG. 1A illustrates a high-level conceptual block diagram of echo-cancellation aspects of an AEC system 100. As illustrated, an audio input 110 provides multi-channel (e.g., stereo) audio "reference" signals $x_1(n)$ 112*a* and $x_2(n)$ 112*b* (e.g., playback reference signals). While FIG. 1A illustrates the audio input 110 providing only two reference signals 112, the disclosure is not limited thereto and the number of reference signals 112 may vary without departing from the disclosure. The reference signal $x_1(n)$ 112*a* is transmitted to a loudspeaker 114*a*, and the reference signal $x_2(n)$ 112*b* is transmitted to a loudspeaker 114*b*. While FIG. 1A illustrates the reference signals x 112 being transmitted using a wired connection, the disclosure is not limited thereto, and the reference signals 112 may be transmitted to the loudspeakers 114 using a wireless connection (e.g., via a radio frequency (RF) link to a wireless loudspeaker 114) without departing from the disclosure.

The first loudspeaker 114*a* outputs first audio $z_1(n)$ 116*a* and the second loudspeaker 114*b* outputs second audio $z_2(n)$ 116*b* in a room (e.g., an environment), and portions of the output sounds are captured by a pair of microphones 118*a* and 118*b* as "echo" signals $y_1(n)$ 120*a* and $y_2(n)$ 120*b* (e.g., input audio data), which contain some of the reproduced sounds from the reference signals $x_1(n)$ 112*a* and $x_2(n)$ 112*b*, in addition to any additional sounds (e.g., speech) picked up by the microphones 118. The echo signals y(n) 120 may be referred to as input audio data and may represent the audible sound output by the loudspeakers 114 and/or the speech input from a speech source (e.g., a first echo signal 120*a* may include a first representation of the audible sound output by the loudspeakers 114 and/or a second representation of the speech input). In some examples, the echo signals y(n) 120 may be combined to generate combined echo signals y(n) 120 (e.g., combined input audio data), although the disclosure is not limited thereto. While FIG. 1A illustrates two microphones 118*a*/118*b*, the disclosure is not limited thereto and the system 100 may include any number of microphones 118 without departing from the present disclosure.

Two or more microphones 118 may be referred to as a microphone array and the device 102 may select a subset of the microphone array (e.g., select a group of microphones from the microphone array) on which to perform beamforming (e.g., perform a beamforming operation to generate beamformed audio data corresponding to individual directions). In some examples, a subset may include only a portion of the microphone array (e.g., a first group of microphones 118), with other portions of the microphone array (e.g., a second group of microphones 118) not included in the subset. However, the disclosure is not limited thereto, and in other examples a subset may include all of the microphones 118 in the microphone array without departing from the disclosure. Additionally or alternatively, the device 102 may select two or more subsets of the microphone array on which to perform beamforming. For example, the device 102 may select a first subset to generate target signals and a second subset to generate reference signals, as will be descried in greater detail below.

As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones in the microphone array (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 102 may generate the beamformed audio data by boosting an audio signal originating from the desired direction (e.g., look direction) while attenuating audio signals that originate from other directions, although the disclosure is not limited thereto.

To perform the beamforming operation, the device 102 may apply directional calculations to the input audio signals. In some examples, the device 102 may perform the directional calculations by applying filters to the input audio signals using filter coefficients associated with specific directions. For example, the device 102 may perform a first directional calculation by applying first filter coefficients to the input audio signals to generate the first beamformed audio data and may perform a second directional calculation by applying second filter coefficients to the input audio signals to generate the second beamformed audio data.

The filter coefficients used to perform the beamforming operation may be calculated offline (e.g., preconfigured ahead of time) and stored in the device 102. For example, the device 102 may store filter coefficients associated with hundreds of different directional calculations (e.g., hundreds of specific directions) and may select the desired filter coefficients for a particular beamforming operation at runtime (e.g., during the beamforming operation). To illustrate an example, at a first time the device 102 may perform a first beamforming operation to divide input audio data into 36 different portions, with each portion associated with a specific direction (e.g., 10 degrees out of 360 degrees) relative to the device 102. At a second time, however, the device 102 may perform a second beamforming operation to divide input audio data into 6 different portions, with each portion associated with a specific direction (e.g., 60 degrees out of 360 degrees) relative to the device 102.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the device 102 stores hundreds of "beams" (e.g., directional calculations and associated filter coefficients) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

An audio signal is a representation of sound and an electronic representation of an audio signal may be referred to as audio data, which may be analog and/or digital without departing from the disclosure. For ease of illustration, the disclosure may refer to either audio signals (e.g., reference signals x(n), echo signal y(n), estimated echo signals $\hat{y}(n)$ or echo estimate signals $\hat{y}(n)$, error signal, etc.) or audio data (e.g., reference audio data or playback audio data, echo audio data or input audio data, estimated echo data or echo estimate data, error audio data, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure.

In a conventional AEC, delayed playback signals (e.g., reference signals x 112) are used to generate an estimated echo signal (e.g., reference signal) that the AEC system cancels from the echo signals y 120 (e.g., target signal). Thus, the playback signals sent to each of the loudspeakers 114*a*/114*b* are used as reference signals and the echo signals captured by the microphones 118*a*/118*b* are used as target signals. To perform AEC, the reference signals may be canceled (e.g., removed) from the target signals by subtracting the estimated echo signal from the echo signal produces an error signal $e_1(n)$ (e.g., isolated audio data). Specifically:

$$\hat{e}_1(n)=y_1(n)-\hat{y}_1(n) \quad [1]$$

However, the disclosure is not limited thereto, and the device 102 may instead generate reference signals from the echo signals y 120. For example, the device 102 may perform first beamforming to determine one or more target signals 122 from a first portion of the echo signals y 120 (e.g., receive first audio data from a first group of microphones and perform a first beamforming operation to generate first beamformed audio data) and may perform beamforming to determine one or more reference signals 124 from a second portion of the echo signals y 120 (e.g., receive second audio data from a second group of microphones and perform a second beamforming operation to generate second beamformed audio data). As will be described in greater detail below, the device 102 may generate the target signals using a first subset of the microphone array and may generate the reference signals using a second subset of the microphone array.

For ease of explanation, the disclosure may refer to removing an estimated echo signal from a target signal to perform acoustic echo cancellation and/or removing an estimated interference signal from a target signal to perform acoustic interference cancellation. The system 100 removes the estimated echo/interference signal by subtracting the estimated echo/interference signal from the target signal, thus cancelling the estimated echo/interference signal. This cancellation may be referred to as "removing," "subtracting" or "cancelling" interchangeably without departing from the disclosure. Additionally or alternatively, in some examples the disclosure may refer to removing an acoustic echo, ambient acoustic noise and/or acoustic interference. As the acoustic echo, the ambient acoustic noise and/or the acoustic interference are included in the input audio data and the system 100 does not receive discrete audio signals corresponding to these portions of the input audio data, removing the acoustic echo/noise/interference corresponds to estimating the acoustic echo/noise/interference and cancelling the estimate from the target signal.

For ease of explanation, the disclosure may refer to acoustic echo cancellation (AEC). However, as the reference signals are generated from input audio data captured by the microphones 118 (e.g., instead of from delayed playback signals sent to the loudspeakers 114), removing the reference signals may correspond to cancelling an acoustic echo (e.g., audible sound output by the loudspeakers 114), ambient noise (e.g., ambient noise in the environment around the device 102) and/or acoustic interference (e.g., a combination of acoustic echo and ambient noise) and the disclosure does not differentiate between the three.

As illustrated in FIG. 1A, the device 102 may include a beamformer 150 that may perform audio beamforming on the echo signals y(n) 120 to determine target signals 122 and/or reference signals 124. In some examples, the beamformer 150 may include a fixed beamformer (FBF) 160 and/or an adaptive noise canceller (ANC) 170, although the disclosure is not limited thereto. The FBF 160 may be configured to form a beam in a specific direction so that a target signal 122 is passed and all other signals are attenuated, enabling the beamformer 150 to select a particular direction (e.g., directional portion of the echo reference signals y(n) 120 or the combined echo reference signal). In contrast, the ANC 170 may be configured to form a null in a specific direction so that the target signal is attenuated and all other signals are passed and may generate the reference signals 124 using the other signals that are passed.

While the abovementioned examples describe the FBF 160 forming a beam associated with a look direction and the ANC 170 forming beams associated with non-look directions, the disclosure is not limited thereto. Instead, the beamformer 150 may input first audio data corresponding to a first subset of the microphone array to the FBF 160 (e.g., data generated by the first group of microphones) and may input second audio data corresponding to a second subset of the microphone array to the ANC 170 (e.g., data generated by the second group of microphones). The FBF 160 may generate one or more target signals 122 from the first audio data and the ANC 170 may generate one or more reference signals 124 from the second audio data. Thus, the target signals 122 may not be associated with a look direction without departing from the disclosure. Instead, the device 102 may perform first beamforming on the first audio data to generate first beams and may select one or more of the first beams as the target signals 122. Similarly, the device 102 may perform second beamforming on the second audio data to generate second beams and may select one or more of the second beams as the reference signals 124.

The beamformer 150 may generate fixed beamforms (e.g., outputs of the FBF 160) or may generate adaptive beamforms using a Linearly Constrained Minimum Variance (LCMV) beamformer, a Minimum Variance Distortionless Response (MVDR) beamformer or other beamforming techniques. For example, the beamformer 150 may receive audio input, determine six beamforming directions and output six fixed beamform outputs and six adaptive beamform outputs. In some examples, the beamformer 150 may generate six fixed beamform outputs, six LCMV beamform outputs and six MVDR beamform outputs, although the disclosure is not limited thereto. Using the beamformer 150 and techniques discussed below, the device 102 may determine the target signals 122 to pass to an acoustic echo cancellation (AEC) 108.

The system 100 may perform acoustic echo cancellation using the AEC 108 to generate isolated audio data 126. For example, the AEC 108 may subtract the reference signals 124 from the target signals 122 to generate the isolated audio data 126. In some examples, the system 100 may perform acoustic echo cancellation for each target signal 122. Thus, the system 100 may perform acoustic echo cancellation for a single target signal and generate a single output (e.g., isolated audio data 126). Additionally or alternatively, the system 100 may perform acoustic echo cancellation for multiple target signals and generate multiple outputs without departing from the disclosure.

The AEC 108 may subtract the reference signals 124 (e.g., reproduced sounds) from the target signals 122 (e.g., reproduced sounds and additional sounds such as speech) to cancel the reproduced sounds and isolate the additional sounds (e.g., speech) as isolated audio data 126, as shown in equation [2].

$$\text{Target}=s+z+\text{noise} \quad [2]$$

where s is speech (e.g., the additional sounds), z is an echo from the signal sent to the loudspeaker (e.g., the reproduced sounds) and noise is additional noise that is not associated with the speech or the echo. In order to attenuate the echo (z), the device 102 may select a portion of the input audio data as the reference signals 124, which may be shown in equation [3]:

$$\text{Estimated Echo}=z+\text{noise} \quad [3]$$

By subtracting the reference signals 124 from the target signals 122, the device 102 may cancel the acoustic echo and generate the isolated audio data 126 including only the speech and some noise. The device 102 may use the isolated audio data 126 to perform speech recognition processing on the speech to determine a command and may execute the command. For example, the device 102 may determine that the speech corresponds to a command to play music and the device 102 may play music in response to receiving the speech.

For ease of explanation, FIG. 1A illustrates the AEC 108 as a separate component from the beamformer 150. However, the disclosure is not limited thereto and the beamformer 150 may include components that remove the reference signals 124 from the target signals 122 without departing from the disclosure. Thus, the beamformer 150 may output the isolated audio data 126 without departing from the disclosure.

As illustrated in FIG. 1A, the device 102 may receive (130) audio data from a microphone array, may determine (132) a first subset of the microphone array, and may perform (134) audio beamforming to generate first beams using the first subset. For example, the device 102 may receive the audio input from a microphone array including all of the microphones 118, may select a first portion of the audio input that is associated with the first subset of the microphone array and may perform audio beamforming to separate the first portion of the audio input into separate directions (e.g., determine first audio data associated with a first group of microphones and perform a first beamforming operation to generate target beamformed audio data, which includes first beamformed audio data associated with a first direction and second beamformed audio data associated with a second direction). The device 102 may then determine (136) a second subset of the microphone array and perform (138) audio beamforming to generate second beams using the second subset. For example, the device 102 may select a second portion of the audio input that is associated with the second subset of the microphone array and may perform audio beamforming to separate the second portion of the audio input into separate directions (e.g., determine second audio data associated with a second group of microphones and perform a second beamforming operation to generate reference beamformed audio data, which includes third beamformed audio data associated with a third direction and fourth beamformed audio data associated with a fourth direction).

The device 102 may select (140) at least a portion of the first beams as target signal(s) (e.g., target data), such as target signals 122. The target signal(s) may include a single target signal (e.g., a single beam of the first beams) or may include multiple target signals (e.g., target signal 122*a*, target signal 122*b*, . . . target signal 122*n*). The device 102 may select (142) at least a portion of the second beams as reference signal(s) (e.g., reference data), such as reference signals 124. The reference signal(s) may include a single reference signal (e.g., a single beam of the second beams) or may include multiple reference signals (e.g., reference signal 124*a*, reference signal 124*b*, . . . reference signal 124*n*).

The device 102 may remove (144) the reference signal(s) from the target signal(s) 122 to generate isolated audio data (e.g., isolated audio data 126) and may output (146) the isolated audio data including the speech or additional sounds. For example, the device 102 may cancel an echo from the target signals 122 by subtracting the reference signals 124 in order to isolate speech or additional sounds. For example, the device 102 may cancel music (e.g., reproduced sounds) played over the loudspeakers 114 to isolate a voice command input to the microphones 118. The device 102 may output the isolated audio data to a remote device (e.g., remote servers), which may perform automatic speech recognition (ASR) to determine text, determine a command from the text and execute the command or send an instruction to the device 102 to execute the command.

The device 102 may include a microphone array having multiple microphones 118 that are laterally spaced from each other so that they can be used by audio beamforming components to produce directional audio signals. The microphones 118 may, in some instances, be dispersed around a perimeter of the device 102 in order to apply beampatterns to audio signals based on sound captured by the microphone(s) 118. For example, the microphones 118 may be positioned at spaced intervals along a perimeter of the device 102, although the present disclosure is not limited thereto. In some examples, the microphone(s) 118 may be spaced on a substantially vertical surface of the device 102 and/or a top surface of the device 102. Each of the microphones 118 is omnidirectional, and beamforming technology is used to produce directional audio signals based on signals from the microphones 118. In other embodiments, the microphones may have directional audio reception, which may remove the need for subsequent beamforming.

Using the plurality of microphones 118 the device 102 may employ beamforming techniques to isolate desired sounds for purposes of converting those sounds into audio signals for speech processing by the system. Beamforming is the process of applying a set of beamformer coefficients to audio signal data to create beampatterns, or effective directions of gain or attenuation. In some implementations, these volumes may be considered to result from constructive and destructive interference between signals from individual microphones in a microphone array.

The device 102 may include a beamformer 150 that may include one or more audio beamformers or beamforming components that are configured to generate an audio signal that is focused in a direction from which user speech has been detected. More specifically, the beamforming components may be responsive to spatially separated microphone elements of the microphone array to produce directional audio signals that emphasize sounds originating from different directions relative to the device 102, and to select and output one of the audio signals that is most likely to contain user speech.

Audio beamforming, also referred to as audio array processing, uses a microphone array having multiple microphones 118 that are spaced from each other at known distances. Sound originating from a source is received by each of the microphones 118. However, because each microphone 118 is potentially at a different distance from the sound source, a propagating sound wave arrives at each of the microphones 118 at slightly different times. This difference in arrival time results in phase differences between audio signals produced by the microphones 118. The phase differences can be exploited to enhance sounds originating from chosen directions relative to the microphone array.

Beamforming uses signal processing techniques to combine signals from the different microphones 118 so that sound signals originating from a particular direction are emphasized while sound signals from other directions are deemphasized. More specifically, signals from the different microphones 118 are combined in such a way that signals from a particular direction experience constructive interference, while signals from other directions experience destructive interference. The parameters used in beamforming may be varied to dynamically select different directions, even when using a fixed-configuration microphone array.

A given beampattern may be used to selectively gather signals from a particular spatial location where a signal source is present. The selected beampattern may be configured to provide gain or attenuation for the signal source. For example, the beampattern may be focused on a particular user's head allowing for the recovery of the user's speech while attenuating noise from an operating air conditioner that is across the room and in a different direction than the user relative to a device that captures the audio signals.

Such spatial selectivity by using beamforming allows for the rejection or attenuation of undesired signals outside of the beampattern. The increased selectivity of the beampattern improves signal-to-noise ratio for the audio signal. By improving the signal-to-noise ratio, the accuracy of speaker recognition performed on the audio signal is improved.

The processed data from the beamformer module may then undergo additional filtering or be used directly by other modules. For example, a filter may be applied to processed data which is acquiring speech from a user to remove residual audio noise from a machine running in the environment.

Figure 2A:
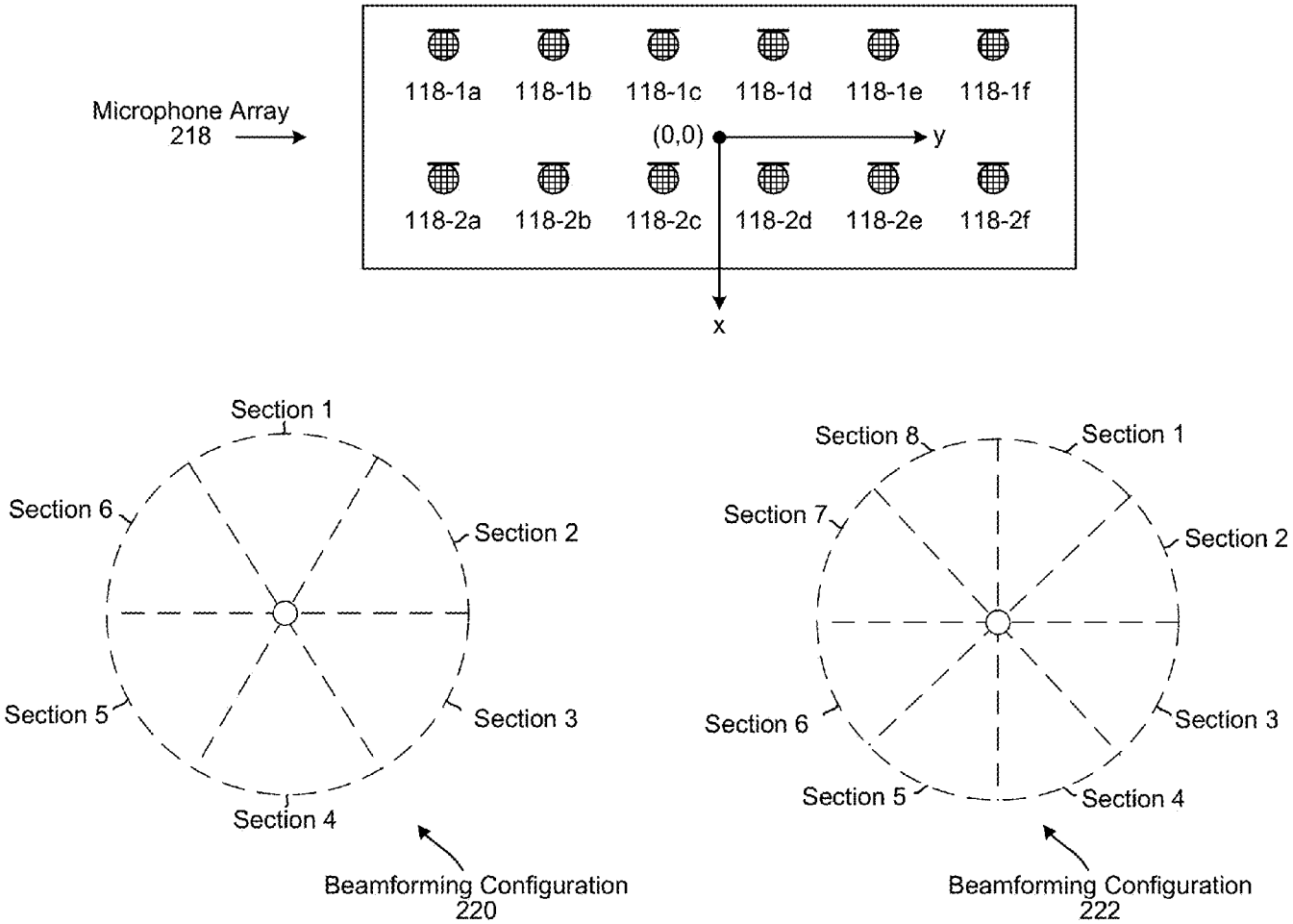
FIGS. 2A-2B illustrate examples of performing beamforming using a microphone array.
Figure 2B:
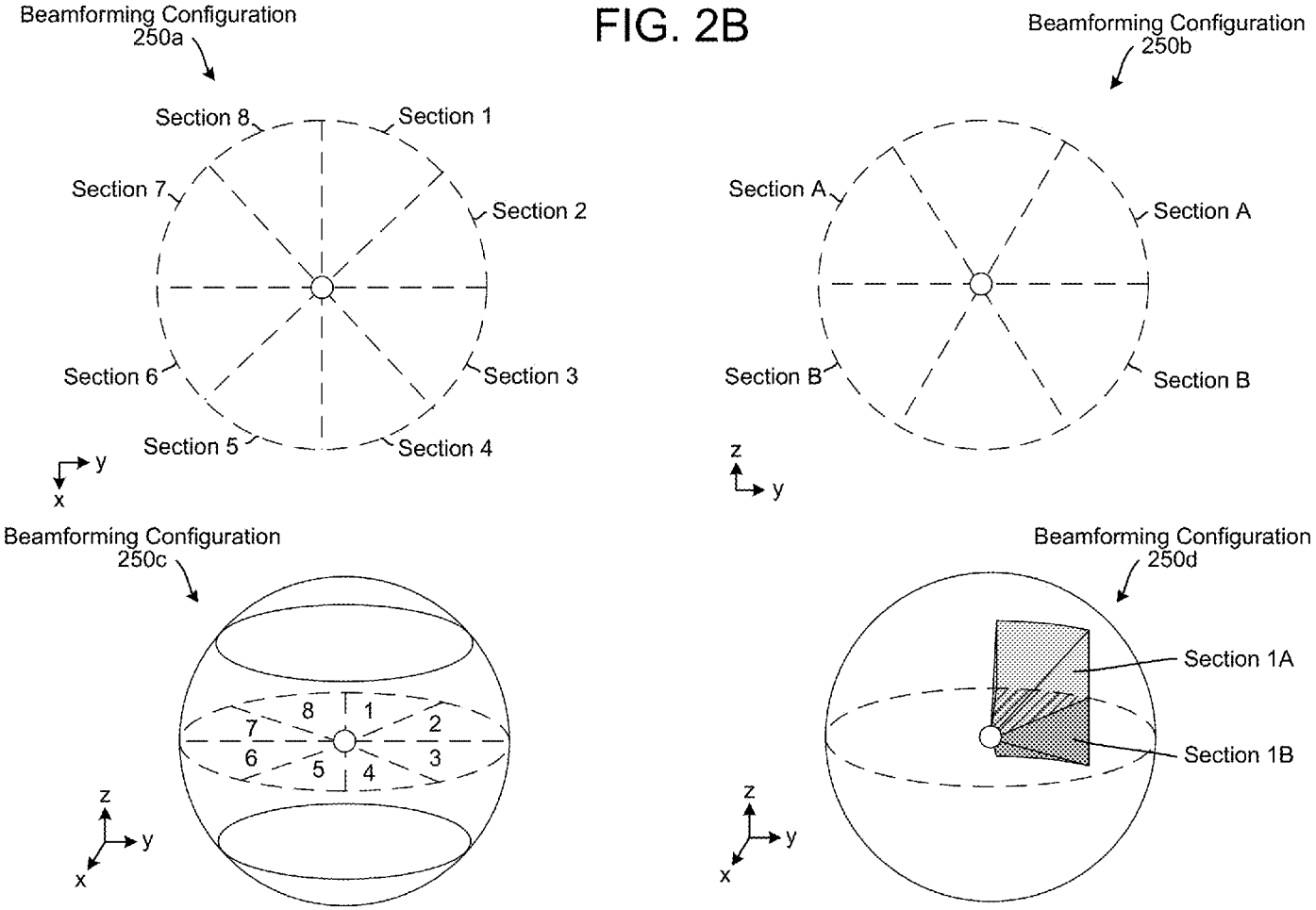

FIGS. 2A-2B illustrate performing beamforming using a microphone array. As illustrated in FIG. 2A, the device 102 may perform beamforming to determine a plurality of portions or sections (e.g., directional portions) using audio data received from a microphone array 218. Typically, an entirety of the microphone array 218 is used to generate the audio data and perform beamforming. Thus, a reference point (e.g., 0, 0) indicates a center of the microphone array 218 and the reference point may be used to indicate relative positions of the individual microphones 118 in the microphone array 218 and to perform beamforming such that the plurality of beams are centered on the reference point.

FIG. 2A illustrates a beamforming configuration 220 including six portions or sections (e.g., Sections 1-6). For example, the device 102 may include six different microphones 118, may divide an area around the device 102 into six sections or the like. However, the present disclosure is not limited thereto and the number of microphones 118 in the microphone array and/or the number of portions/sections in the beamforming may vary. As another example, the device 102 may generate a beamforming configuration 222 including eight portions/sections (e.g., Sections 1-8) without departing from the disclosure. For example, the device 102 may include eight different microphones 118, may divide the area around the device 102 into eight portions/sections or the like. Thus, the following examples may perform beamforming and separate an audio signal into eight different portions/sections, but these examples are intended as illustrative examples and the disclosure is not limited thereto.

While FIG. 2A illustrates beamforming configurations that are two dimensional, beamforming may instead be three dimensional. Thus, a device may use audio data corresponding to the entirety of the microphone array to generate beams that are three dimensional, as illustrated in FIG. 2B. For example, a first beamforming configuration 250*a* illustrates that the beams may be divided into eight sections along an x-y plane while a second beamforming configuration illustrates that the beams may be divided into two sections along a y-z plane. To combine the two, a third beamforming configuration 250*c* illustrates that the eight sections exist in three dimensions. Finally, a fourth beamforming configuration 250*d* illustrates that the two-dimensional Section 1 illustrated in the first beamforming configuration 250*a* may correspond to a three-dimensional Section 1A and Section 1B, with Section 1A corresponding to an upper portion of Section 1 (e.g., positive values along the z-axis) and Section 1B corresponding to a lower portion of Section 1 (e.g., negative values along the z-axis).

While FIG. 2B illustrates dividing each section into two portions along the z-axis, the disclosure is not limited thereto and the number of sections may vary without departing from the disclosure. While beams may be associated with three-dimensional (3D) directions (e.g., vectors having three coordinates), the calculations associated with each vector can be complicated. As a result, extensive computations using three-dimensional vectors may result in degraded performance and/or increased processing load on the device 102.

The number of portions/sections generated using beamforming does not depend on the number of microphones 118 in the microphone array. For example, the device 102 may include twelve microphones 118 in the microphone array but may determine three portions, six portions or twelve portions of the audio data without departing from the disclosure. As discussed above, the beamformer 150 may generate fixed beamforms (e.g., outputs of the FBF 160) or may generate adaptive beamforms using a Linearly Constrained Minimum Variance (LCMV) beamformer, a Minimum Variance Distortionless Response (MVDR) beamformer or other beamforming techniques. For example, the beamformer 150 may receive the audio input, may determine six beamforming directions and output six fixed beamform outputs and six adaptive beamform outputs corresponding to the six beamforming directions. In some examples, the beamformer 150 may generate six fixed beamform outputs, six LCMV beamform outputs and six MVDR beamform outputs, although the disclosure is not limited thereto.

The device 102 may determine a number of loudspeakers 114 and/or directions associated with the loudspeakers 114 using the fixed beamform outputs. For example, the device 102 may localize energy in the frequency domain and clearly identify much higher energy in two directions associated with two wireless loudspeakers (e.g., a first direction associated with a first loudspeaker 114 and a second direction associated with a second loudspeaker 114). In some examples, the device 102 may determine an existence and/or location associated with the loudspeakers 114 using a frequency range (e.g., 1 kHz to 3 kHz), although the disclosure is not limited thereto. In some examples, the device 102 may determine an existence and location of the loudspeaker(s) 114 using the fixed beamform outputs, may select a portion of the fixed beamform outputs as the target signal(s) and may select a portion of adaptive beamform outputs corresponding to the loudspeaker(s) 114 as the reference signal(s).

To perform echo cancellation, the device 102 may determine a target signal and a reference signal and may subtract the reference signal from the target signal to generate an output signal. For example, the loudspeaker may output audible sound associated with a first direction and a person may generate speech associated with a second direction. To cancel the audible sound output from the loudspeaker, the device 102 may select a first portion of audio data corresponding to the first direction as the reference signal and may select a second portion of the audio data corresponding to the second direction as the target signal. However, the disclosure is not limited to a single portion being associated with the reference signal and/or target signal and the device 102 may select multiple portions of the audio data corresponding to multiple directions as the reference signal/target signal without departing from the disclosure. For example, the device 102 may select a first portion and a second portion as the reference signal and may select a third portion and a fourth portion as the target signal.

Additionally or alternatively, the device 102 may determine more than one reference signal and/or target signal. For example, the device 102 may identify a first loudspeaker and a second loudspeaker and may determine a first reference signal associated with the first loudspeaker and determine a second reference signal associated with the second loudspeaker. The device 102 may generate a first output by subtracting the first reference signal from the target signal and may generate a second output by subtracting the second reference signal from the target signal. Similarly, the device 102 may select a first portion of the audio data as a first target signal and may select a second portion of the audio data as a second target signal. The device 102 may therefore generate a first output by subtracting the reference signal from the first target signal and may generate a second output by subtracting the reference signal from the second target signal.

The device 102 may determine reference signals, target signals and/or output signals using any combination of portions of the audio data without departing from the disclosure. For example, the device 102 may select first and second portions of the audio data as a first reference signal, may select a third portion of the audio data as a second reference signal and may select remaining portions of the audio data as a target signal. In some examples, the device 102 may include the first portion in a first reference signal and a second reference signal or may include the second portion in a first target signal and a second target signal. If the device 102 selects multiple target signals and/or multiple reference signals, the device 102 may subtract each reference signal from each of the target signals individually (e.g., subtract reference signal 1 from target signal 1, subtract reference signal 1 from target signal 2, subtract reference signal 2 from target signal 1, etc.), may collectively subtract the reference signals from each individual target signal (e.g., subtract reference signals 1-2 from target signal 1, subtract reference signals 1-2 from target signal 2, etc.), subtract individual reference signals from the target signals collectively (e.g., subtract reference signal 1 from target signals 1-2, subtract reference signal 2 from target signals 1-2, etc.) or any combination thereof without departing from the disclosure.

The device 102 may select fixed beamform outputs or adaptive beamform outputs as the target signal(s) and/or the reference signal(s) without departing from the disclosure. In a first example, the device 102 may select a first fixed beamform output (e.g., first portion of the audio data determined using fixed beamforming techniques) as a reference signal and a second fixed beamform output as a target signal. In a second example, the device 102 may select a first adaptive beamform output (e.g., first portion of the audio data determined using adaptive beamforming techniques) as a reference signal and a second adaptive beamform output as a target signal. In a third example, the device 102 may select the first fixed beamform output as the reference signal and the second adaptive beamform output as the target signal. In a fourth example, the device 102 may select the first adaptive beamform output as the reference signal and the second fixed beamform output as the target signal. However, the disclosure is not limited thereto and further combinations thereof may be selected without departing from the disclosure.

In some examples, the device 102 may associate specific directions with the reproduced sounds and/or speech based on features of the signal sent to the loudspeaker. Examples of features includes power spectrum density, peak levels, pause intervals or the like that may be used to identify the signal sent to the loudspeaker and/or propagation delay between different signals. For example, the beamformer 150 may compare the signal sent to the loudspeaker with a signal associated with a first direction to determine if the signal associated with the first direction includes reproduced sounds from the loudspeaker. When the signal associated with the first direction matches the signal sent to the loudspeaker, the device 102 may associate the first direction with a wireless loudspeaker. When the signal associated with the first direction does not match the signal sent to the loudspeaker, the device 102 may associate the first direction with speech, a speech position, a person or the like.

The device 102 may determine a speech position (e.g., near end talk position) associated with speech and/or a person speaking. For example, the device 102 may identify the speech, a person and/or a position associated with the speech/person using audio data (e.g., audio beamforming when speech is recognized), video data (e.g., facial recognition) and/or other inputs known to one of skill in the art. The device 102 may determine target signals 122, which may include a single target signal (e.g., echo signal 120 received from a microphone 118) or may include multiple target signals (e.g., target signal 122*a*, target signal 122*b*, . . . target signal 122*n*). In some examples, the device 102 may determine the target signals based on the speech position. The device 102 may determine an adaptive reference signal based on the speech position and/or the audio beamforming. For example, the device 102 may associate the speech position with a target signal and may select an opposite direction as the adaptive reference signal.

The device 102 may determine the target signals and the adaptive reference signal using multiple techniques, which are discussed in greater detail below. For example, the device 102 may use a first technique when the device 102 detects a clearly defined loudspeaker signal, a second technique when the device 102 doesn't detect a clearly defined loudspeaker signal but does identify a speech position and/or a third technique when the device 102 doesn't detect a clearly defined loudspeaker signal or a speech position. Using the first technique, the device 102 may associate the clearly defined loudspeaker signal with the adaptive reference signal and may select any or all of the other directions as the target signal. For example, the device 102 may generate a single target signal using all of the remaining directions for a single loudspeaker or may generate multiple target signals using portions of remaining directions for multiple loudspeakers. Using the second technique, the device 102 may associate the speech position with the target signal and may select an opposite direction as the adaptive reference signal. Using the third technique, the device 102 may select multiple combinations of opposing directions to generate multiple target signals and multiple adaptive reference signals.

The device 102 may cancel an acoustic echo from the target signal by subtracting the adaptive reference signal to isolate speech or additional sounds and may output second audio data including the speech or additional sounds. For example, the device 102 may cancel music (e.g., reproduced sounds) played over the loudspeakers 114 to isolate a voice command input to the microphones 118. As the adaptive reference signal is generated based on the echo signals 120 input to the microphones 118, the second audio data is an example of an ARSSA AEC system.

The system 100 may use short-time Fourier transform-based frequency-domain acoustic echo cancellation (STFT AEC). The following high level description of STFT AEC refers to echo signal y 120, which is a time-domain signal comprising an echo from at least one loudspeaker 114 and is the output of a microphone 118. The reference signal x 112 is a time-domain audio signal that is sent to and output by a loudspeaker 114. The variables X and Y correspond to a Short Time Fourier Transform of x and y respectively, and thus represent frequency-domain signals. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "m" is a frequency index.

The system 100 may apply a short-time Fourier transform (STFT) to the time-domain reference signal y(n) 120, producing the frequency-domain reference values Y(m,n), where the tone index "m" ranges from 0 to M and "n" is a frame index ranging from 0 to N. In some examples, the system 100 may also apply an STFT to the time domain signal x(n) 112, producing frequency-domain input values X(m,n). However, as the system 100 illustrated in FIGS. 1A-1B don't perform acoustic echo cancellation using reference signals derived from the reference signals x 112, the disclosure is not limited thereto. The history of the values across iterations is provided by the frame index "n", which ranges from 1 to N and represents a series of samples over time.

In some examples, the system 100 may perform an M-point STFT on a time-domain signal. If a 256-point STFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. Each tone index in the 256-point STFT corresponds to a frequency range (e.g., subband) in the 16 kHz time-domain signal. However, the disclosure is not limited to the frequency range being divided into 256 different subbands (e.g., tone indexes), and the system 100 may divide the frequency range into M different subbands. In addition, the disclosure is not limited to using a Short-Time Fourier Transform (STFT), and the tone index may be generated using Fast Fourier Transform (FFT), generalized Discrete Fourier Transform (DFT) and/or other transforms known to one of skill in the art (e.g., discrete cosine transform, non-uniform filter bank, etc.).

Given a signal z[n], the STFT Z(m,n) of z[n] is defined by $$Z(m,n)=\sum_{k=0}^{K-1} Win(k)*z(k+n*\mu)*e^{-2pi*m*k/K} \quad [4.1]$$

Where, Win(k) is a window function for analysis, m is a frequency index, n is a frame index, μ is a step-size (e.g., hop size), and K is an FFT size. Hence, for each block (at frame index n) of K samples, the STFT is performed which produces K complex tones X(m,n) corresponding to frequency index m and frame index n.

Referring to the input signal y(n) 120 from the microphone 118, Y(m,n) has a frequency domain STFT representation:

$$Y(m,n)=\sum_{k=0}^{K-1} Win(k)*y(k+n*\mu)*e^{-2pi*m*k/K} \quad [4.2]$$

Referring to the reference signal x(n) 112 to the loudspeaker 114, X(m,n) has a frequency domain STFT representation:

$$X(m,n)=\sum_{k=0}^{K-1} Win(k)*x(k+n*\mu)*e^{-2pi*m*k/K} \quad [4.3]$$

The system 100 may determine the number of tone indexes and the step-size controller 190 may determine a step-size value for each tone index (e.g., subband). Thus, the frequency-domain reference values X(m,n) and the frequency-domain input values Y(m,n) are used to determine individual step-size parameters for each tone index "m," generating individual step-size values on a frame-by-frame basis. For example, for a first frame index "1," the step-size controller 190 may determine a first step-size parameter μ(m) for a first tone index "m," a second step-size parameter μ(m+1) for a second tone index "m+1," a third step-size parameter μ(m+2) for a third tone index "m+2" and so on. The step-size controller 190 may determine updated step-size parameters for a second frame index "2," a third frame index "3," and so on.

For each channel of isolated audio data 126 (e.g., each stream of output audio), the step-size controller 190 may perform the steps discussed above to determine a step-size value μ for each tone index on a frame-by-frame basis. Thus, a first reference frame index and a first input frame index corresponding to a first output may be used to determine a first plurality of step-size values μ, a second reference frame index and a second input frame index corresponding to a second output may be used to determine a second plurality of step-size values μ, and so on. The step-size controller 190 may provide the step-size values μ to adaptive filters for updating filter coefficients used to perform the acoustic echo cancellation (AEC). For example, the first plurality of step-size values μ may be provided to a first adaptive noise canceller (ANC) 170*a*, the second plurality of step-size values may be provided to a second ANC 170*b*, and so on. The first ANC 170*a* may use the first plurality of step-size values μ to update filter coefficients from previous filter coefficients. For example, an adjustment between the previous transfer function $h_{old}$ and new transfer function $h_{new}$ is proportional to the step-size value μ. If the step-size value μ is closer to one, the adjustment is larger, whereas if the step-size value μ is closer to zero, the adjustment is smaller.

Calculating the step-size values μ for each output/tone index/frame index allows the system 100 to improve steady-state error, reduce a sensitivity to local speech disturbance and improve a convergence rate of the ANC 170. For example, the step-size value μ may be increased when the error signal increases (e.g., the reference signal and the target signal diverge) to increase a convergence rate and reduce a convergence period. Similarly, the step-size value μ may be decreased when the error signal decreases (e.g., the reference signal and the target signal converge) to reduce a rate of change in the transfer functions and therefore more accurately estimate the estimated echo signal 126.

Figure 1B:
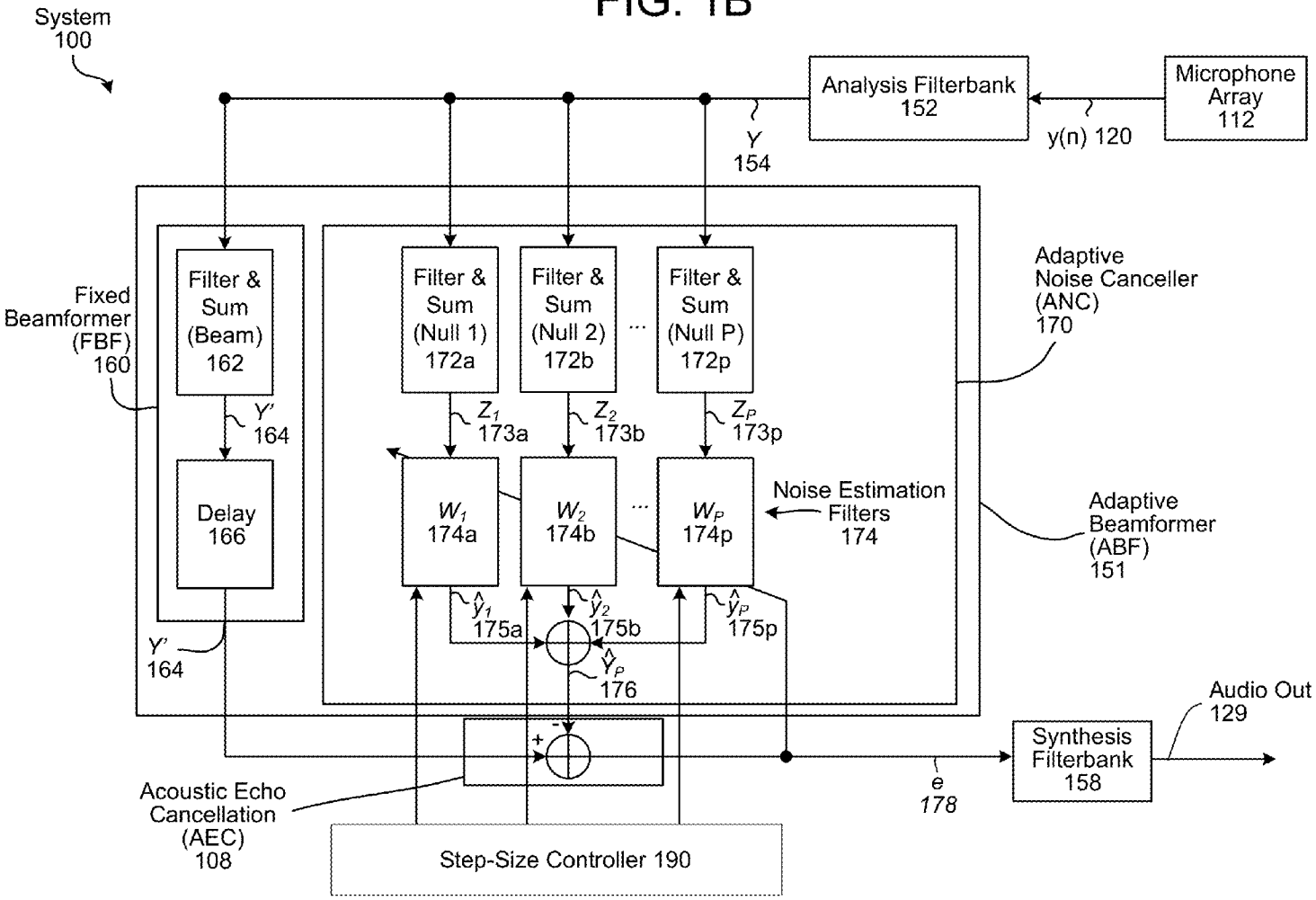

FIG. 1B illustrates a high-level conceptual block diagram of echo-cancellation aspects of an AEC system 100 using an adaptive interference canceller. Some of the components are identical to the example illustrated in FIG. 1A and therefore a corresponding description may be omitted. As discussed above with regard to FIG. 1A, the device 102 may use the isolated audio data 126 to perform speech recognition processing on the speech to determine a command and may execute the command. For example, the device 102 may determine that the speech corresponds to a command to play music and the device 102 may play music in response to receiving the speech.

As illustrated in FIG. 1B, an adaptive beamformer (ABF) 151 may be configured to perform beamforming using a fixed beamformer (ABF) 160 and an adaptive noise canceller (ANC) 170 that can cancel noise from particular directions using adaptively controlled coefficients which can adjust how much noise is cancelled from particular directions. As used herein, the output(s) of the FBF 160 may be referred to as target signals 122 while the output(s) of the ANC 170 may be referred to as reference signals 124. While FIG. 1B illustrates the ANC 170 as including adaptive filters, the disclosure is not limited thereto and the adaptive beamformer 151 may generate the reference signals 124 using only filter and sum techniques without adaptive filtering.

As shown in FIG. 1B, the system 100 generates audio signals Y 154 from audio data 120 generated by a microphone array 118. For example, the audio data 120 is received from the microphone array 118 and processed by an analysis filterbank 152, which converts the audio data 120 from the time domain into the frequency/sub-band domain, where $x_m$ denotes the time-domain microphone data for the mth microphone, m=1, . . . , M. The filterbank 152 divides the resulting audio signals into multiple adjacent frequency bands, resulting in audio signals Y 154. The system 100 then operates a fixed beamformer (FBF) to amplify a first audio signal from a desired direction to obtain an amplified first audio signal Y' 164. For example, the audio signal Y 154 may be fed into a fixed beamformer (FBF) component 160, which may include a filter and sum component 162 associated with the "beam" (e.g., look direction). The FBF 160 may be a separate component or may be included in another component such as a general adaptive beamformer (ABF) 151. As explained below, the FBF 160 may operate a filter and sum component 162 to isolate the first audio signal from the direction of an audio source.

The system 100 may also operate an adaptive noise canceller (ANC) 170 to amplify audio signals from directions other than the direction of an audio source (e.g., non-look directions). Those audio signals represent noise signals so the resulting amplified audio signals from the ANC 170 may be referred to as noise reference signals 173 (e.g., $Z_1$-$Z_P$), discussed further below. The ANC 170 may include filter and sum components 172 which may be used to generate the noise reference signals 173. For ease of illustration, the filter and sum components 172 may also be referred to as nullformers 172 or nullformer blocks 172 without departing from the disclosure. The system 100 may then weight the noise reference signals 173, for example using adaptive filters (e.g., noise estimation filter blocks 174) discussed below. The system may combine the weighted noise reference signals 175 (e.g., $\hat{y}_1$-$\hat{y}_p$) into a combined (weighted) noise reference signal 176 (e.g., $\hat{Y}_P$). Alternatively the system may not weight the noise reference signals 173 and may simply combine them into the combined noise reference signal 176 without weighting. The system may then subtract the combined noise reference signal 176 from the amplified first audio signal Y' 164 to obtain a difference (e.g., error signal 178). The system may then output that difference, which represents the desired output audio signal with the noise cancelled. The diffuse noise is cancelled by the FBF when determining the amplified first audio signal Y' 164 and the directional noise is cancelled when the combined noise reference signal 176 is subtracted. The system may also use the difference to create updated weights (for example for adaptive filters included in the noise estimation filter blocks 174) that may be used to weight future audio signals. The step-size controller 190 may be used modulate the rate of adaptation from one weight to an updated weight.

In this manner noise reference signals are used to adaptively estimate the noise contained in the output of the FBF signal using the noise estimation filter blocks 174. This noise estimate (e.g., combined noise reference signal $\hat{Y}_P$ 176 output by ANC 170) is then subtracted from the FBF output signal (e.g., amplified first audio signal Y' 164) to obtain the final ABF output signal (e.g., error signal 178). The ABF output signal (e.g., error signal 178) is also used to adaptively update the coefficients of the noise estimation filters. Lastly, the system 100 uses a robust step-size controller 190 to control the rate of adaptation of the noise estimation filters.

While FIG. 1B illustrates examples of performing beamforming to select a target signal 122 associated with a look direction and reference signals 124 associated with non-look directions, the disclosure is not limited thereto. Instead, the adaptive beamformer 151 may input first audio data corresponding to a first subset of the microphone array to the FBF 160 and may input second audio data corresponding to a second subset of the microphone array to the ANC 170. The FBF 160 may generate one or more target signals 122 from the first audio data and the ANC 170 may generate one or more reference signals 124 from the second audio data. Thus, the target signals 122 may not be associated with a look direction without departing from the disclosure. Instead, the device 102 may perform first beamforming on the first audio data to generate first beams and may select one or more of the first beams as the target signals 122. Similarly, the device 102 may perform second beamforming on the second audio data to generate second beams and may select one or more of the second beams as the reference signals 124.

Referring back to FIG. 1B, audio data 120 captured by a microphone array may be input into an analysis filterbank 152. The filterbank 152 may include a uniform discrete Fourier transform (DFT) filterbank which converts audio data 120 in the time domain into an audio signal Y 154 in the sub-band domain. The audio signal Y 154 may incorporate audio signals corresponding to multiple different microphones as well as different sub-bands (i.e., frequency ranges) as well as different frame indices (i.e., time ranges). Thus the audio signal from the mth microphone may be represented as $X_m(k,n)$, where k denotes the sub-band index and n denotes the frame index. The combination of all audio signals for all microphones for a particular sub-band index frame index may be represented as X(k,n).

The audio signal Y 154 may be passed to the FBF 160 including the filter and sum component 162. For ease of illustration, the filter and sum component 162 may also be referred to as a beamformer 162 or beamformer block 162 without departing from the disclosure. The FBF 160 may be implemented as a robust super-directive beamformer (SDBF), delay and sum beamformer (DSB), differential beamformer, or the like. The FBF 160 is presently illustrated as a super-directive beamformer (SDBF) due to its improved directivity properties. The filter and sum component 162 takes the audio signals from each of the microphones and boosts the audio signal from the microphone associated with the desired look direction and attenuates signals arriving from other microphones/directions. The filter and sum component 162 may operate as illustrated in FIG. 3.

Figure 3:
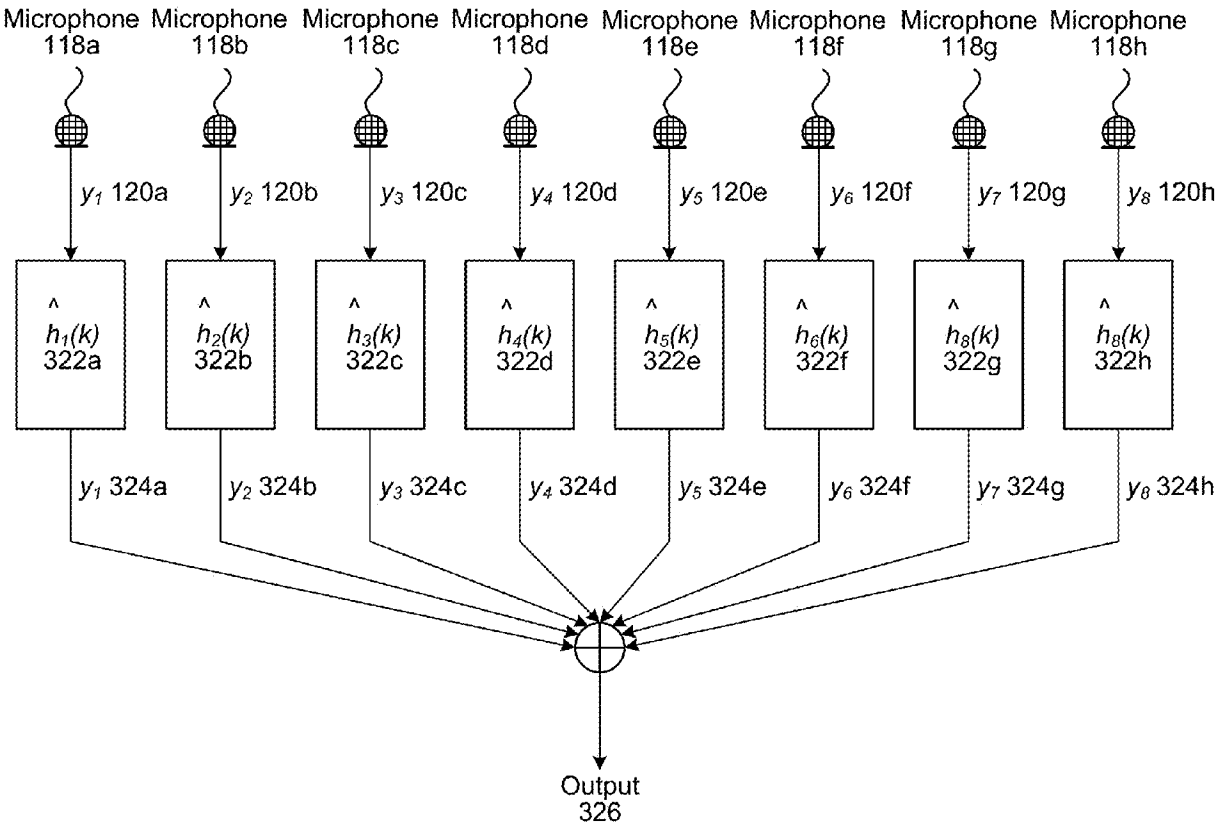
FIG. 3 illustrates an example of a filter and sum component according to embodiments of the present disclosure.

As shown in FIG. 3, the filter and sum component 162 may be configured to match the number of microphones 118 of the microphone array. For example, for a microphone array with eight microphones 118, the filter and sum component 162 may have eight filter blocks 322. The audio signals $x_1$ 120*a* through $x_8$ 120*h* for each microphone 118 are received by the filter and sum component 162. The audio signals $x_1$ 120*a* through $x_8$ 120*h* correspond to individual microphones 118*a* through 118*h*, for example audio signal $x_1$ 120*a* corresponds to microphone 118*a*, audio signal $x_2$ 120*b* corresponds to microphone 118*b* and so forth. Although shown as originating at the microphones 118, the audio signals $x_1$ 120*a* through $x_8$ 120*h* may be in the sub-band domain and thus may actually be output by the analysis filterbank 152 before arriving at the filter and sum component 162. Each filter block 322 is associated with a particular microphone 118 (e.g., filter block 322*a* corresponds to first microphone 118*a*, second filter block 322*b* corresponds to second microphone 118*b*, etc.) and is configured to either boost (e.g., increase) or dampen (e.g., decrease) its respective incoming audio signal by the respective beamformer filter coefficient h depending on the configuration of the FBF 160. Each resulting filtered audio signal y 324 will be the audio signal y 120 weighted by the beamformer filter coefficient h of the filter block 322. For example, $\hat{y}_1 = {}^*h_1$, $\hat{y}_2 = y_2{}^*h_2$, and so forth. The beamformer filter coefficients h are configured for a particular FBF 160 associated with a particular beam. The sum of all of the filtered audio signals y 324 is the output 326.

Figure 4:
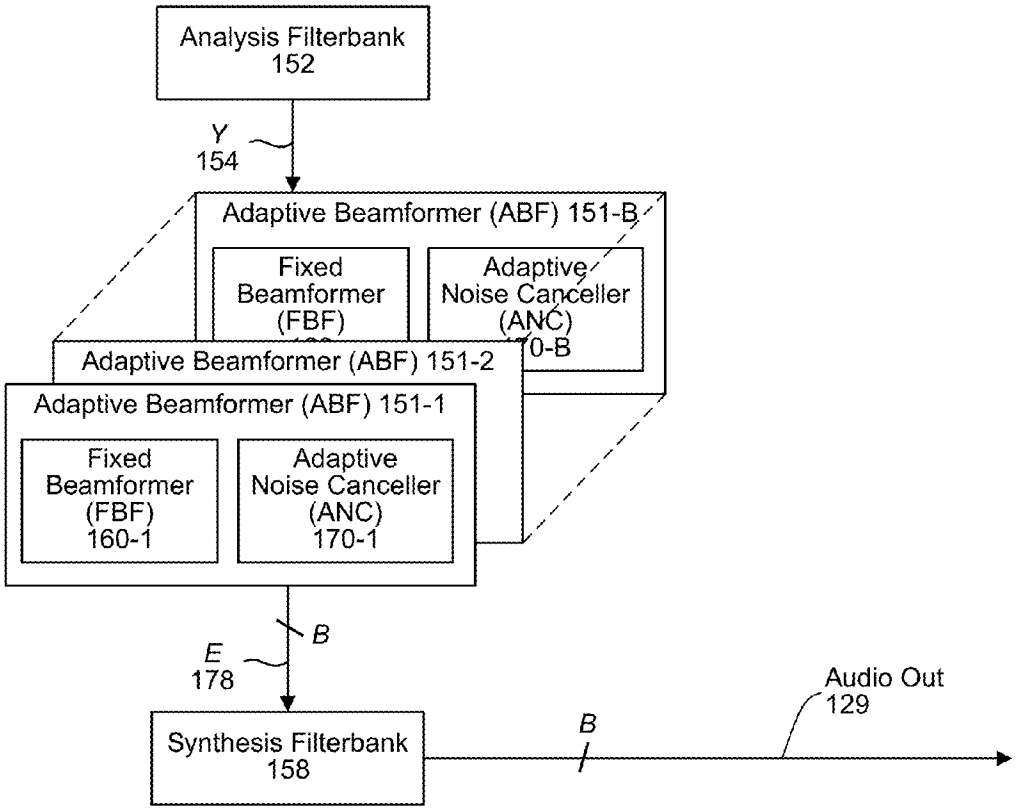
FIG. 4 illustrates a configuration having an adaptive beamformer for each beam according to embodiments of the present disclosure.

As illustrated in FIG. 4, the adaptive beamformer (ABF) 151 configuration (including the FBF 160 and the ANC 170) illustrated in FIG. 1B, may be implemented multiple times in a single system 100. The number of adaptive beamformer 151 blocks may correspond to the number of beams B. For example, if there are eight beams, there may be eight FBF components 160 and eight ANC components 170. Each adaptive beamformer 151 may operate as described in reference to FIG. 1B, with an individual output e (e.g., error signal 178) for each beam created by the respective adaptive beamformer 151. Thus, B different error signals 178 may result. For system configuration purposes, there may also be B different other components, such as the synthesis filterbank 158, but that may depend on system configuration. Each individual beam pipeline may result in its own isolated audio data 126, such that there may be B different outputs of isolated audio data 126. A downstream component, for example a speech recognition component, may receive all the different isolated audio data 126 and may use some processing to determine which beam (or beams) correspond to the most desirable audio output data (for example a beam with a highest SNR output audio data or the like).

In some examples, each particular FBF 160 may be tuned with filter coefficients to boost audio from one of the particular beams. For example, FBF 160-1 may be tuned to boost audio from beam 1, FBF 160-2 may be tuned to boost audio from beam 2 and so forth. If the filter block is associated with the particular beam, its beamformer filter coefficient h will be high whereas if the filter block is associated with a different beam, its beamformer filter coefficient h will be lower. For example, for FBF 160-7 direction 7, the beamformer filter coefficient $h_7$ for filter block 322*g* may be high while beamformer filter coefficients $h_1$-$h_6$ and $h_8$ may be lower. Thus the filtered audio signal $y_7$ will be comparatively stronger than the filtered audio signals $y_1$-$y_6$ and $y_8$ thus boosting audio from direction 7 relative to the other directions. The filtered audio signals will then be summed together to create the amplified first audio signal Y' 164. Thus, the FBF 160 may phase align microphone data toward a given direction and add it up. Signals that are arriving from a particular direction (e.g., look direction) are reinforced, but signals that are not arriving from the look direction are suppressed. The robust FBF coefficients are designed by solving a constrained convex optimization problem and by specifically taking into account the gain and phase mismatch on the microphones. The filter coefficients will be used for all audio signals Y 154 until if/when they are reprogrammed. Thus, in contrast to the adaptive filter coefficients used in the noise estimation filters 174, the filter coefficients used in the filter blocks 322 are static.

The individual beamformer filter coefficients may be represented as $H_{BF,m}(r)$, where r=0, . . . R, where R denotes the number of beamformer filter coefficients in the subband domain. Thus, the amplified first audio signal Y' 164 output by the filter and sum component 162 may be represented as the summation of each microphone signal filtered by its beamformer coefficient and summed up across the M microphones:

$$Y(k, n) = \sum_{m=1}^{M} \sum_{r=0}^{R} H_{BF,m}(r) X_m(k, n-r) \quad [5]$$

Turning once again to FIG. 1B, the amplified first audio signal Y' 164, expressed in equation [5], may be fed into a delay component 166, which delays the forwarding of the output Y until further adaptive noise cancelling functions as described below may be performed. One drawback to the amplified first audio signal Y' 164, however, is that it may include residual directional noise that was not canceled by the FBF 160. To cancel that directional noise, the system 100 may operate an adaptive noise canceller (ANC) 170 which includes components to obtain the remaining noise reference signal which may be used to cancel the remaining noise from the amplified first audio signal Y' 164.

As shown in FIG. 1B, the ANC 170 may include a number of nullformer blocks 172*a* through 172*p*. The system 100 may include P number of nullformer blocks 172 where P corresponds to the number of channels, where each channel corresponds to a direction in which the system may focus the nullformer blocks 172 to isolate detected noise. The number of channels P is configurable and may be predetermined for a particular system 100. Each nullformer block 172 is configured to operate similarly to the beamformer block 162, only instead of the beamformer filter coefficients h for the nullformer blocks being selected to boost the look direction, they are selected to boost one of the other, non-look directions. Thus, for example, nullformer 172*a* is configured to boost audio from direction 1, nullformer 172*b* is configured to boost audio from direction 2, and so forth. Thus, the nullformer may actually dampen the desired audio (e.g., speech) while boosting and isolating undesired audio (e.g., noise). For example, nullformer 172*a* may be configured (e.g., using a high beamformer filter coefficient $h_1$ for filter block 322*a*) to boost the signal from microphone 118*a*/direction 1, regardless of the look direction. Nullformers 172*b* through 172*p* may operate in similar fashion relative to their respective microphones/directions, though the individual coefficients for a particular channel's nullformer in one beam pipeline may differ from the individual coefficients from a nullformer for the same channel in a different beam's pipeline. The output Z 173 of each nullformer block 172 will be a boosted signal corresponding to a non-desired direction.

In some examples, each particular filter and sum component 172 may be tuned with beamformer filter coefficients h to boost audio from one or more directions, with the beamformer filter coefficients h fixed until the filter and sum component 172 is reprogrammed. For example, a first filter and sum component 172*a* may be tuned to boost audio from a first direction, a second filter and sum component 172*b* may be tuned to boost audio from a second direction, and so forth. If a filter block 322 is associated with the particular direction (e.g., first filter block 322*a* in the first filter and sum component 172*a* that is associated with the first direction), its beamformer filter coefficient h will be high whereas if the filter block 322 is associated with a different direction, its beamformer filter coefficient h will be lower.

To illustrate an example, for filter and sum component 172*c* direction 3, the beamformer filter coefficient $h_3$ for the third filter block 322*c* may be high while beamformer filter coefficients $h_1$-$h_6$ and $h_8$ may be lower. Thus the filtered audio signal $y_3$ will be comparatively stronger than the filtered audio signals $y_1$-$y_2$ and $y_4$-$y_8$ thus boosting audio from direction 3 relative to the other directions. The filtered audio signals will then be summed together to create the third output Z 173*c*. Thus, the filter and sum components 172 may phase align microphone data toward a given direction and add it up. Signals that are arriving from a particular direction are reinforced, but signals that are not arriving from the particular direction are suppressed. The robust beamformer filter coefficients h are designed by solving a constrained convex optimization problem and by specifically taking into account the gain and phase mismatch on the microphones 118. The beamformer filter coefficients h will be used for all audio signals Y 154 until if/when they are reprogrammed. Thus, in contrast to the adaptive filter coefficients used in the noise estimation filters 174, the beamformer filter coefficients h used in the filter blocks 322 are static.

While FIG. 3 was previously described with reference to the filter and sum component 162, the components illustrated in FIG. 3 may also illustrate an operation associated with individual filter and sum components 172. Thus, a filter and sum component 172 may be configured to match the number of microphones 118 of the microphone array. For example, for a microphone array with eight microphones 118, the filter and sum component 172 may have eight filter blocks 322. The audio signals $x_1$ 120*a* through $x_8$ 120*h* for each microphone 118 are received by the filter and sum component 172. The audio signals $x_1$ 120*a* through $x_8$ 120*h* correspond to individual microphones 118*a* through 118*h*, for example audio signal $x_1$ 120*a* corresponds to microphone 118*a*, audio signal $x_2$ 120*b* corresponds to microphone 118*b* and so forth. Although shown as originating at the microphones 118, the audio signals $x_1$ 120*a* through $x_8$ 120*h* may be in the sub-band domain and thus may actually be output by the analysis filterbank 152 before arriving at the filter and sum component 172. Each filter block 322 is associated with a particular microphone 118 (e.g., filter block 322*a* corresponds to first microphone 118*a*, second filter block 322*b* corresponds to second microphone 118*b*, etc.) and is configured to either boost (e.g., increase) or dampen (e.g., decrease) its respective incoming audio signal by the respective beamformer filter coefficient h depending on the configuration of the filter and sum component 172. Each resulting filtered audio signal y 324 will be the audio signal y 120 weighted by the beamformer filter coefficient h of the filter block 322. For example, $\hat{y}_1=y_1*h_1$, $\hat{y}_2=y_2*h_2$, and so forth. The beamformer filter coefficients h are configured for a particular filter and sum component 172 associated with a particular beam.

Thus, each of the beamformer 162/nullformers 172 receive the audio signals Y 154 from the analysis filterbank 152 and generate an output using the filter blocks 322. While each of the beamformer 162/nullformers 172 receive the same input (e.g., audio signals Y 154), the outputs vary based on the respective beamformer filter coefficient h used in the filter blocks 322. For example, a beamformer 162, a first nullformer 172*a* and a second nullformer 172*b* may receive the same input, but an output of the beamformer 162 (e.g., amplified first audio signal Y' 164) may be completely different than outputs of the nullformers 172*a*/172*b*. In addition, a first output from the first nullformer 172*a* (e.g., first noise reference signal 173*a*) may be very different from a second output from the second nullformer 172*b* (e.g., second noise reference signal 173*b*). The beamformer filter coefficient h used in the filter blocks 322 may be fixed for each of the beamformer 162/nullformers 172. For example, the beamformer filter coefficients h used in the filter blocks 322 may be designed by solving a constrained convex optimization problem and by specifically taking into account the gain and phase mismatch on the microphones. The beamformer filter coefficients h will be used for all audio signals Y 154 until if/when they are reprogrammed. Thus, in contrast to the adaptive filter coefficients used in the noise estimation filters 174, the beamformer filter coefficients h used in the filter blocks 322 are static.

As audio from non-desired direction may include noise, each signal Z 173 may be referred to as a noise reference signal. Thus, for each channel 1 through P the ANC 170 calculates a noise reference signal Z 173, namely $Z_1$ 173*a* through $Z_P$ 173*p*. Thus, the noise reference signals that are acquired by spatially focusing towards the various noise sources in the environment and away from the desired look-direction. The noise reference signal for channel p may thus be represented as $Z_p(k,n)$ where $Z_p$ is calculated as follows:

$$Z_p(k,n)=\sum_{m=1}^{M}\sum_{r=0}^{R}H_{NF,m}(p,r)X_m(k,n-r) \quad [6]$$

where $H_{NF,m}(p,r)$ represents the nullformer coefficients for reference channel p.

As described above, the coefficients for the nullformer filter blocks 322 are designed to form a spatial null toward the look direction while focusing on other directions, such as directions of dominant noise sources. The output Z 173 (e.g., $Z_1$ 173*a* through $Z_P$ 173*p*) from the individual nullformer blocks 172 thus represent the noise from channels 1 through P.

The individual noise reference signals may then be filtered by noise estimation filter blocks 174 configured with weights W to adjust how much each individual channel's noise reference signal should be weighted in the eventual combined noise reference signal $\hat{Y}$ 176. The noise estimation filters (further discussed below) are selected to isolate the noise to be cancelled from the amplified first audio signal Y' 164. The individual channel's weighted noise reference signal $\hat{y}$ 175 is thus the channel's noise reference signal Z multiplied by the channel's weight W. For example, $\hat{y}_1=Z_1*W_1$, $\hat{y}_2=Z_2*W_2$, and so forth. Thus, the combined weighted noise estimate $\hat{Y}$ 176 may be represented as:

$$\hat{Y}_P(k,n)=\Sigma_{l=0}^{L}W_P(k,n,l)Z_P(k,n-l) \quad [7]$$

where $W_p(k,n,l)$ is the lth element of $W_p(k,n)$ and l denotes the index for the filter coefficient in subband domain. The noise estimates of the P reference channels are then added to obtain the overall noise estimate:

$$\hat{Y}(k,n)=\sum_{p=1}^{P}\hat{Y}_p(k,n) \quad [8]$$

The combined weighted noise reference signal $\hat{Y}$ 176, which represents the estimated noise in the audio signal, may then be subtracted from the amplified first audio signal Y' 164 to obtain an error signal e 178 (e.g., output audio data), which represents the error between the combined weighted noise reference signal $\hat{Y}$ 176 and the amplified first audio signal Y' 164. The error signal e 178 is thus the estimated desired non-noise portion (e.g., target signal portion) of the audio signal and may be the output of the adaptive beamformer 151. The error signal e 178, may be represented as:

$$E(k,n)=Y(k,n)-\hat{Y}(k,n) \quad [9]$$

As shown in FIG. 1B, the error signal 178 may also be used to update the weights W of the noise estimation filter blocks 174 using sub-band adaptive filters, such as with a normalized least mean square (NLMS) approach:

$$W_p(k,n)=W_p(k,n-1)+\frac{\mu_p(k,n)}{\|z_p(k,n)\|^2+\varepsilon}z_p(k,n)E(k,n) \quad [10]$$

where $Z_p(k,n)=[Z_p(k,n)\ Z_p(k,n-1)\ .\ .\ .\ Z_p(k,n-L)]^T$ is the noise estimation vector for the pth channel, $\mu_p(k,n)$ is the adaptation step-size for the pth channel, and ε is a regularization factor to avoid indeterministic division. The weights may correspond to how much noise is coming from a particular direction.

As can be seen in equation [10], the updating of the weights W involves feedback. The weights W are recursively updated by the weight correction term (the second half of the right hand side of equation [9]) which depends on the adaptation step size, $\mu_p(k,n)$, which is a weighting factor adjustment to be added to the previous weighting factor for the filter to obtain the next weighting factor for the filter (to be applied to the next incoming signal). To ensure that the weights are updated robustly (to avoid, for example, target signal cancellation) the step size $\mu_p(k,n)$ may be modulated according to signal conditions. For example, when the desired signal arrives from the look direction, the step-size is significantly reduced, thereby slowing down the adaptation process and avoiding unnecessary changes of the weights W. Likewise, when there is no signal activity in the look direction, the step-size may be increased to achieve a larger value so that weight adaptation continues normally. The step-size may be greater than 0, and may be limited to a maximum value. Thus, the system may be configured to determine when there is an active source (e.g., a speaking user) in the look-direction. The system may perform this determination with a frequency that depends on the adaptation step size.

The step-size controller 190 will modulate the rate of adaptation. Although not shown in FIG. 1B, the step-size controller 190 may receive various inputs to control the step size and rate of adaptation including the noise reference signals 173, the amplified first audio signal Y' 164, the previous step size, the nominal step size (described below) and other data. The step-size controller 190 may compute the adaptation step-size for each channel p, sub-band k, and frame n. To make the measurement of whether there is an active source in the look-direction, the system may measure a ratio of the energy content of the beam in the look direction (e.g., the look direction signal in amplified first audio signal Y' 164) to the ratio of the energy content of the beams in the non-look directions (e.g., the non-look direction signals of noise reference signals $Z_1$ 173*a* through $Z_P$ 173*p*). This may be referred to as a beam-to-null ratio (BNR). For each subband, the system may measure the BNR. If the BNR is large, then an active source may be found in the look direction, if not, an active source may not be in the look direction.

At a first time period, audio signals from the microphone array 118 may be processed as described above using a first set of weights for the noise estimation filter blocks 174. Then, the error signal e 178 associated with that first time period may be used to calculate a new set of weights for the noise estimation filter blocks 174. The new set of weights may then be used to process audio signals from a microphone array 118 associated with a second time period that occurs after the first time period. Thus, for example, a first filter weight may be applied to a noise reference signal associated with a first audio signal for a first microphone/first direction from the first time period. A new first filter weight may then be calculated and the new first filter weight may then be applied to a noise reference signal associated with the first audio signal for the first microphone/first direction from the second time period. The same process may be applied to other filter weights and other audio signals from other microphones/directions.

The estimated non-noise (e.g., output) error signal e 178 may be processed by a synthesis filterbank 158 which converts the error signal 178 into time-domain audio output 129 which may be sent to a downstream component (such as a speech processing system) for further operations.

For ease of explanation, the disclosure may refer to removing an estimated echo signal from a target signal to perform acoustic echo cancellation and/or removing an estimated interference signal from a target signal to perform acoustic interference cancellation. The system 100 removes the estimated echo/interference signal by subtracting the estimated echo/interference signal from the target signal, thus cancelling the estimated echo/interference signal. This cancellation may be referred to as "removing," "subtracting" or "cancelling" interchangeably without departing from the disclosure. Additionally or alternatively, in some examples the disclosure may refer to removing an acoustic echo, ambient acoustic noise and/or acoustic interference. As the acoustic echo, the ambient acoustic noise and/or the acoustic interference are included in the input audio data and the system 100 does not receive discrete audio signals corresponding to these portions of the input audio data, removing the acoustic echo/noise/interference corresponds to estimating the acoustic echo/noise/interference and cancelling the estimate from the target signal.

Figure 5:
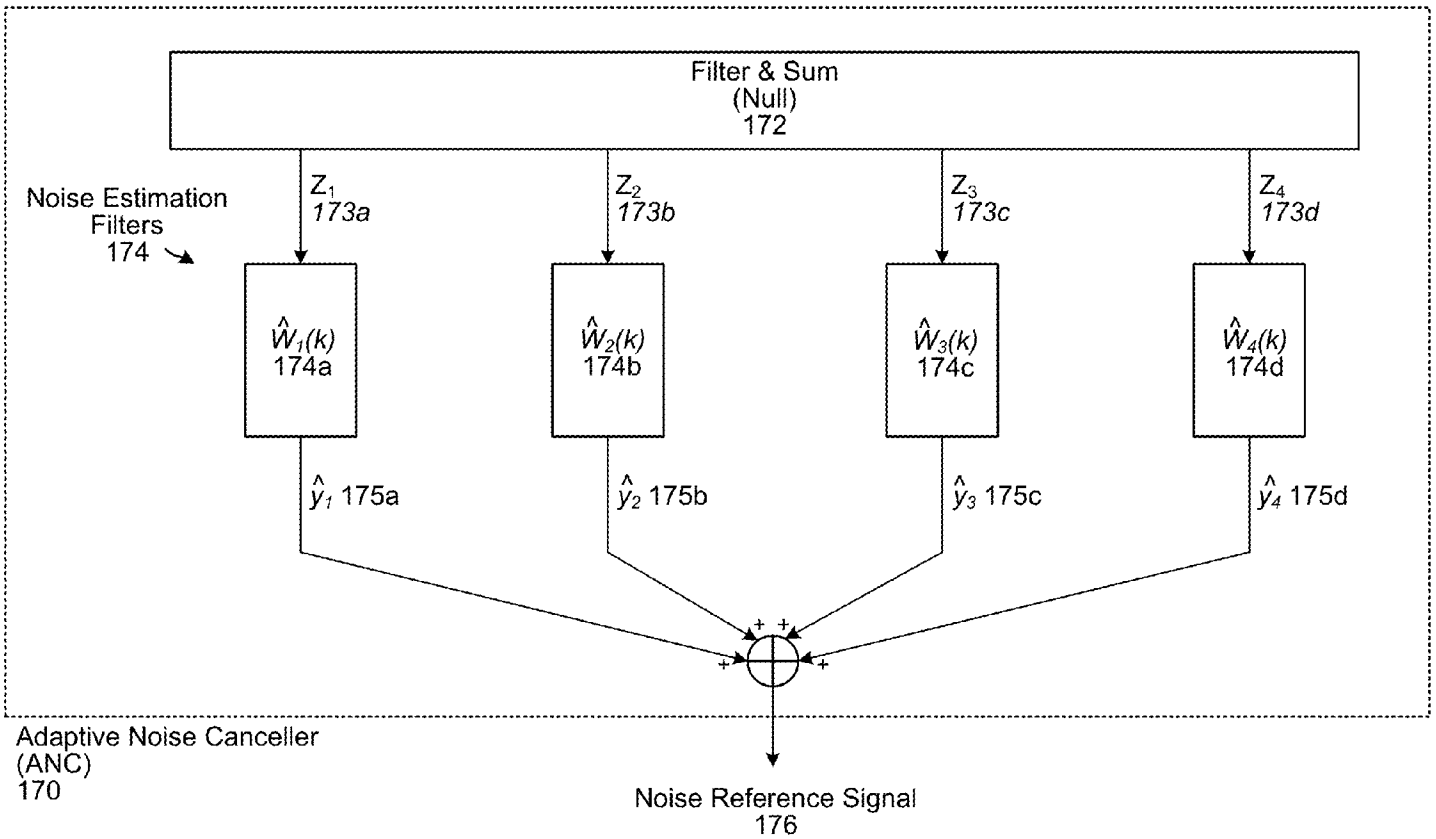
FIG. 5 illustrates an example of adaptive filters according to embodiments of the present disclosure.

FIG. 5 illustrates an example of adaptive filters according to embodiments of the present disclosure. As illustrated in FIG. 5, the filter and sum component 172 may generate noise reference signals Z 173 (e.g., $Z_1$ 173*a*-$Z_4$ 173*d*). The individual noise reference signals Z 173 may then be filtered by noise estimation filter blocks 174 configured with weights W to adjust how much each individual channel's noise reference signal Z 173 should be weighted in the eventual combined noise reference signal $\hat{Y}$ 176, as discussed above with regard to FIG. 1B. For example, the noise estimation filters 174 (e.g., adaptive filter coefficients) are selected to isolate the noise to be cancelled from the amplified first audio signal Y' 164. The individual channel's weighted noise reference signal $\hat{y}$ 175 is thus the channel's noise reference signal Z 173 multiplied by the channel's weight W. For example, $\hat{y}_1=Z_1*W_1$, $\hat{y}_2=Z_2*W_2$, and so forth. While FIG. 5 illustrates four noise reference signals Z 173 (e.g., 173*a*-173*d*), the disclosure is not limited thereto and the number of reference signals Z 173 generated by the filter and sum component 172 may vary without departing from the disclosure.

The system 100 may use the noise reference signals Z 173 (e.g., $Z_p(k,n)$) to estimate the acoustic noise and acoustic echo components (hereby termed acoustic interference estimate) in the FBF 160 output (e.g., the amplified first audio signal Y' 164). The system 100 may use the noise filters (e.g., $W_p(k,n)$) and the echo estimation filters (e.g., $H_t(k,n)$). The contribution for the interference estimate by the ANC 170 is given as:

$$\hat{Y}_{A/C}(k,n)=\sum_{p=1}^{P}\hat{Y}_{p,A/C}(k,n) \quad [11]$$

where $$\hat{Y}_{p,A/C}(k,n)=\sum_{r=0}^{R_1}W_p(k,n,r)Z_p(k,n-r) \quad [12]$$

with $W_p(k,n,r)$ denoting the rth element of $W_p(k,n)$. This noise estimate is subtracted from the FBF 160 output (e.g., the amplified first audio signal Y' 164) to obtain the error signal e 178:

$$E(k,n)=Y(k,n)-\hat{Y}(k,n) \quad [13]$$

Lastly, the error signal e 178 is used to update the filter coefficients (e.g., noise estimation filter blocks 174) for the ANC 170 using subband adaptive filters like the NLMS (normalized least mean square) algorithm:

$$W_p(k,n)=W_p(k,n-1)+\frac{\mu_{p,A/C}(k,n)}{\|z_p(k,n)\|^2+\varepsilon}z_p(k,n)E(k,n) \quad [14]$$

where, $Z_p(k,n)=[Z_p(k,n)\ Z_p(k,n-1)\ \ldots\ Z_p(k,n-R_1)]^T$ is the noise estimation vector for the pth channel, $\mu_{p,AIC}(k,n)$ is the adaptation step-size for the pth channel, and ε is a regularization factor. Note that the step-sizes $\mu_{p,AIC}(k,n)$ are updated using the step-size controller 190, as discussed in greater detail above.

Figure 6A:
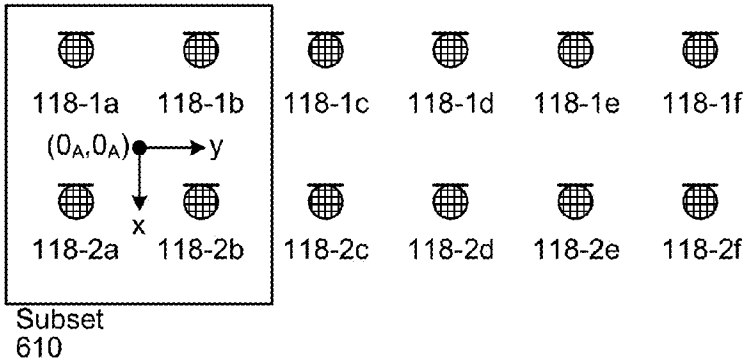
FIGS. 6A-6B illustrate examples of performing beamforming using subset(s) of a microphone array according to embodiments of the present disclosure.
Figure 6B:
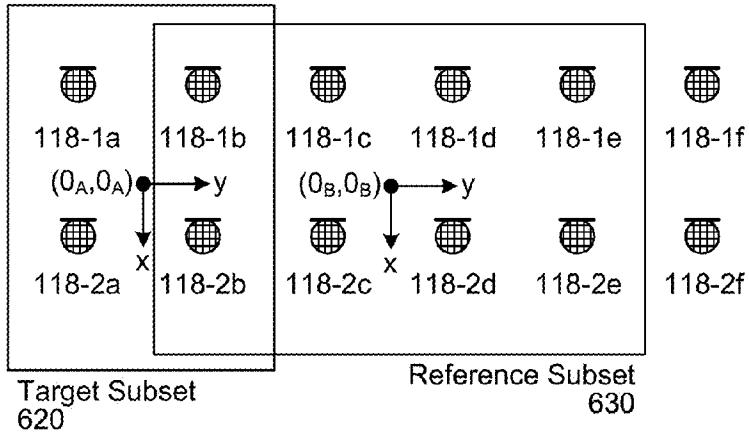

FIGS. 6A-6B illustrate examples of performing beamforming using subset(s) of a microphone array according to embodiments of the present disclosure. As illustrated in FIG. 6A, the device 102 may select only a subset 610 of microphones 118 from a microphone array and may perform beamforming using only the subset 610 of microphones 118. For example, FIG. 6A illustrates the subset 610 including four microphones 118 (e.g., microphones 118-1*a*, 118-1*b*, 118-2*a* and 118-2*b*) out of the twelve microphones 118 included in the microphone array. However, the disclosure is not limited thereto and a number of microphones 118 included in the subset 610 may vary without departing from the disclosure. The device 102 may use the subset 610 to perform beamforming and may select target signal(s) from the plurality of beams. In some examples, the device 102 may select target signal(s) from the plurality of beams and may use playback signals (e.g., output audio data) sent to one or more loudspeaker(s) as reference signals in a traditional multi-channel acoustic echo cancellation (MC-AEC system). However, the disclosure is not limited thereto and, additionally or alternatively, the device 102 may select reference signal(s) from the plurality of beams as well without departing from the disclosure.

As illustrated in FIG. 6A, the device 102 may determine coordinates $(0_A, 0_A)$ indicating a local origin associated with the subset 610 (e.g., center of the subset 610). The device 102 may use the local origin to determine individual offsets for each microphone included in the subset 610. For example, the device 102 may determine a first offset (−1, −1) indicating a first position of a first microphone 118-1*a* relative to the local origin, a second offset (−1, 1) indicating a second position of a second microphone 118-1*b* relative to the local origin, a third offset (1, −1) indicating a third position of a third microphone 118-2*a* relative to the local origin, and a fourth offset (1, 1) indicating a fourth position of a fourth microphone 118-2*b* relative to the local origin. The device 102 may use these offsets to perform beamforming (e.g., a beamforming operation) to generate beams centered on the local origin.

The local origin may be referred to as a reference location, local coordinates or the like without departing from the disclosure. As illustrated in FIG. 6A, the local origin may be associated with a center of the subset 610, such that the beams are centered on the local origin (e.g., a first beam corresponds to first audio data associated with a first direction relative to the first local origin, a second beam corresponds to second audio data associated with a second direction relative to the first local origin, etc.). However, the disclosure is not limited thereto and the local origin can be positioned anywhere relative to the subset 610. For example, the local origin may be associated with the first position of the first microphone 118-1*a*, and each microphone in the subset 610 may be associated with an individual offset relative to the first microphone 118-1*a* (e.g., the second microphone 118-1*b* may be associated with an offset (1, 0) that indicates a position of the second microphone 118-1*b* relative to the first microphone 118-1*a*, etc.). Thus, the device 102 may determine relative positions of each microphone in the subset 610 and perform a beamforming operation based on the relative positions.

In some examples, the device 102 may perform first beamforming using a target subset 620 (e.g., first group of microphones) and may perform second beamforming using a reference subset 630 (e.g., second group of microphones).

Thus, instead of selecting target signal(s) and/or reference signal(s) from the beams generated using the subset 610, the device 102 may select target signal(s) from first beams generated using the target subset 620 and may select reference signal(s) from second beams generated using the reference subset 630. For example, the device 102 may determine that a user is speaking at a first position relative to the device 102 and may select the target subset 620 to include microphones 118 in proximity to the user, selecting the reference subset 630 to include other microphones 118 in the microphone array. For example, the device 102 may select the reference subset 630 to include microphones 118 in proximity to one or more loudspeakers 114, although the disclosure is not limited thereto.

As illustrated in FIG. 6B, the device 102 may determine first local coordinates ($0_A$, $0_A$) indicating a first local origin associated with the target subset 620 (e.g., center of the target subset 620) and second local coordinates ($0_A$, $0_A$) indicating a second local origin associated with the reference subset 630 (e.g., center of the reference subset 630). The device 102 may use the first local origin to determine individual offsets for each microphone in the target subset 620, as described above with regard to FIG. 6A. The device 102 may use these offsets to perform first beamforming (e.g., a first beamforming operation) to generate target beams centered on the first local origin.

In addition, the device 102 may use the second local origin to determine individual offsets for each microphone in the reference subset 630. For example, the device 102 may determine a first offset (−1, −2) indicating a first position of microphone 118-1*b* relative to the second local origin, a second offset (−1, −1) indicating a second position of microphone 118-1*c* relative to the second local origin, a third offset (−1, 1) indicating a third position of microphone 118-1*d* relative to the second local origin, a fourth offset (−1, 2) indicating a fourth position of microphone 118-1*e* relative to the second local origin, a fifth offset (1, −2) indicating a fifth position of microphone 118-2*b* relative to the second local origin, a sixth offset (1, −1) indicating a sixth position of microphone 118-2*c* relative to the second local origin, a seventh offset (1, 1) indicating a seventh position of microphone 118-2*d* relative to the second local origin, and an eighth offset (1, 2) indicating an eighth position of microphone 118-2*e* relative to the second local origin. The device 102 may use these offsets to perform beamforming (e.g., a beamforming operation) to generate reference beams centered on the second local origin.

As discussed above with regard to FIG. 6A, the first local origin may be associated with a center of the target subset 620, such that the target beams are centered on the first local origin (e.g., a first target beam corresponds to first target audio data associated with a first direction relative to the first local origin, a second target beam corresponds to second target audio data associated with a second direction relative to the first local origin, etc.). Similarly, the second local origin may be associated with a center of the reference subset 630, such that the reference beams are centered on the second local origin (e.g., a first reference beam corresponds to first reference audio data associated with a first direction relative to the second local origin, a second reference beam corresponds to second reference audio data associated with a second direction relative to the second local origin, etc.). However, the disclosure is not limited thereto and the first local origin and/or the second local origin may be positioned anywhere without departing from the disclosure.

As illustrated in FIG. 6B, microphones 118 may be included in both the target subset 620 and the reference subset 630 without departing from the disclosure. For example, some microphones 118 may be included in a single subset (e.g., microphones 118-1*a* and 118-2*a* included in target subset 620), some microphones 118 may be included in multiple subsets (e.g., microphones 118-1*b* and 118-2*b* included in target subset 620 and reference subset 630), and some microphones 118 may not be included in any subset (e.g., microphones 118-1*f* and 118-2*f*).

While FIG. 6B illustrates two subsets of the microphone array, the disclosure is not limited thereto. Instead, the device 102 may select as many subsets of the microphone array as necessary without departing from the disclosure. For example, the device 102 may select two or more subsets to generate target signals and/or may select two or more subsets to generate reference signals without departing from the disclosure. Additionally or alternatively, the device 102 may perform beamforming to generate first beams using a single subset and may select some of the first beams as target signals and some of the first beams as reference signals without departing from the disclosure.

In some examples, the device 102 may select microphones 118 to include in a subset used to generate target signals based on speech input. For example, the device 102 may select microphones 118 in proximity to a location associated with the speech input (e.g., a user speaking) and/or may select microphones 118 orthogonal to the location associated with the speech input (e.g., facing a speech source). Thus, the subset of the microphone array may receive the speech input with less degradation, distortion or noise than other microphones 118 in the microphone array.

In some examples, the device 102 may select microphones 118 to include in a subset used to generate reference signals based on sources of noise (e.g., loudspeakers 114). For example, the device 102 may select microphones 118 in proximity to a location associated with loudspeakers 114 and/or may select microphones 118 orthogonal to the location associated with the loudspeakers 114 (e.g., facing the loudspeakers 114). Thus, the subset of the microphone array may receive audible sound output by the loudspeakers 114 with less degradation, distortion or noise than other microphones 118 in the microphone array. However, the disclosure is not limited thereto and the device 102 may select microphones 118 to include in the subset used to generate reference signals to reduce and/or remove ambient noise in an environment without departing from the disclosure.

While the examples illustrated above refer to the sources of noise as corresponding to loudspeakers 114, the disclosure is not limited thereto and sources of noise may include any source of noise, including loudspeakers 114, engines, motors, mechanical devices or the like. Thus, the subset of the microphone array that is used to generate reference signals may be selected based on proximity to a source of noise and/or a lack of proximity to the speech input.

Figure 7A:
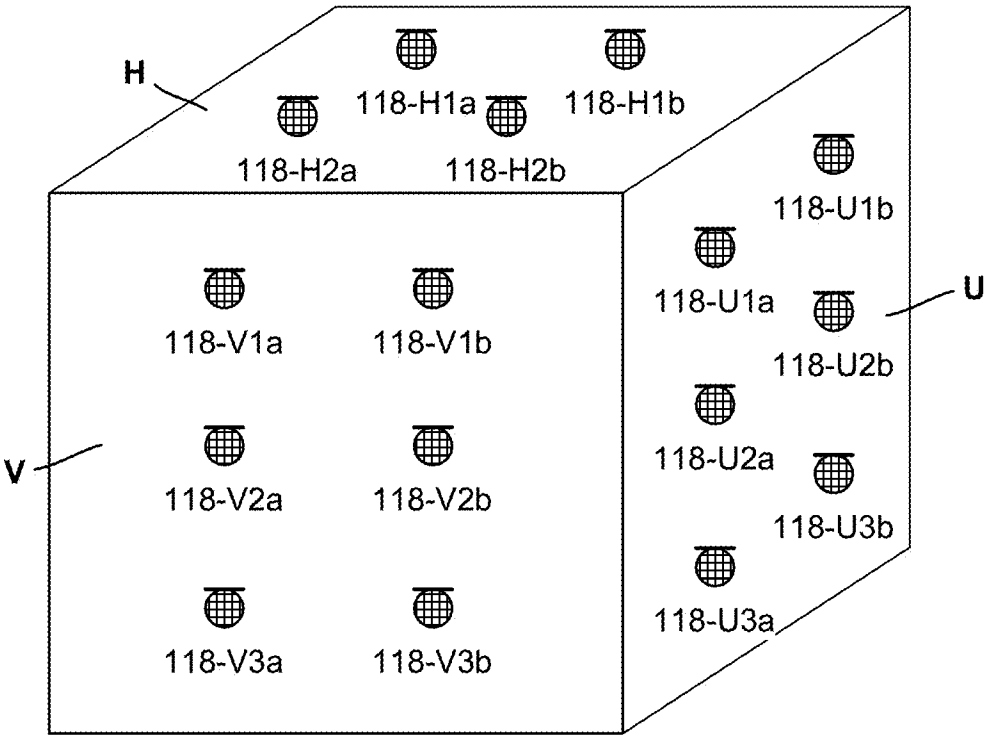
FIGS. 7A-7B illustrate examples of performing beamforming using a three-dimensional microphone array according to embodiments of the present disclosure.
Figure 7B:
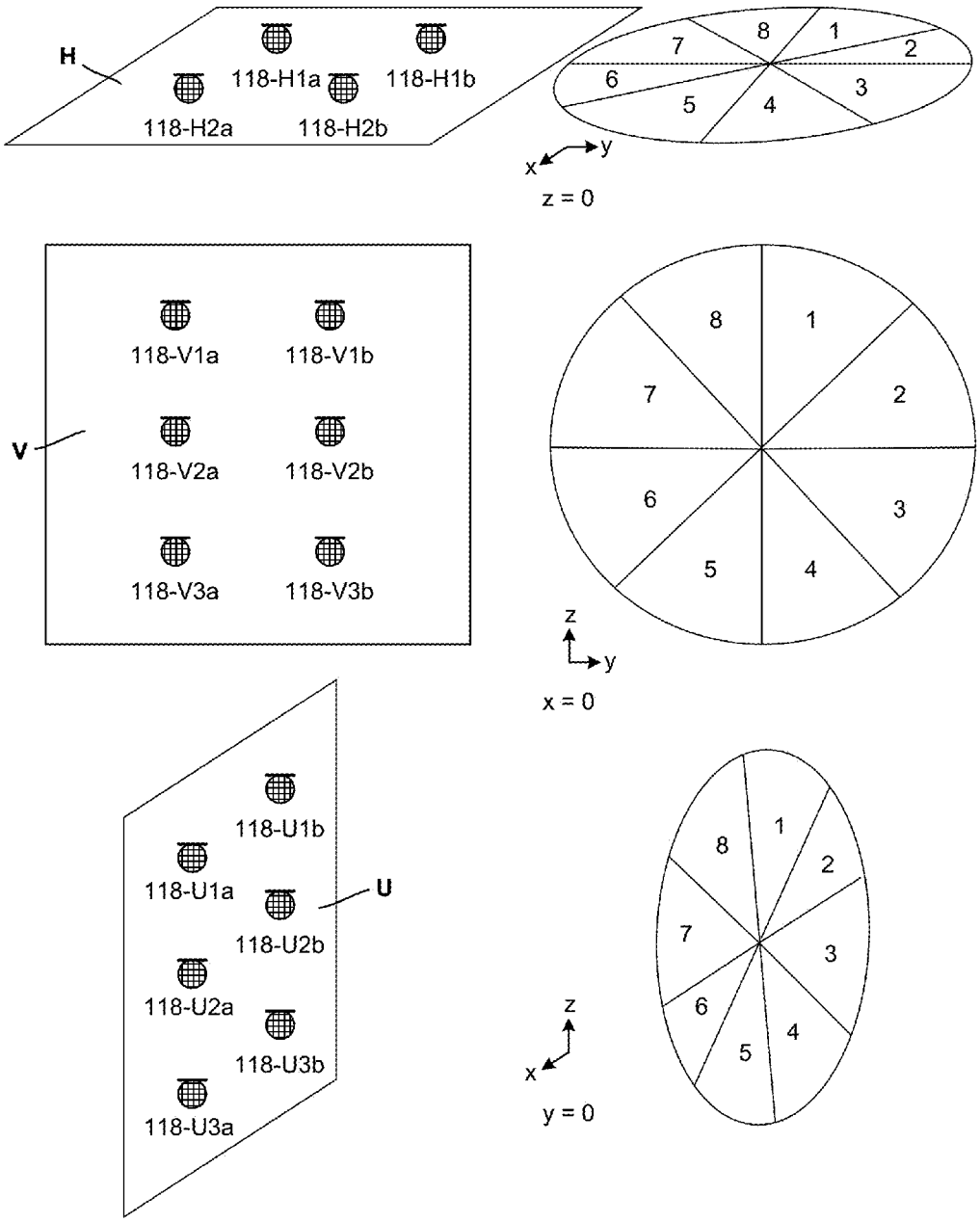

FIGS. 7A-7B illustrate examples of performing beamforming using a three-dimensional microphone array according to embodiments of the present disclosure. As illustrated in FIG. 7A, a microphone array may include microphones 118 along different faces of a three-dimensional (3D) object, such as a cube. For example, FIG. 7A illustrates a cube having a top face H that includes four microphones (e.g., microphones 118-H1*a*, 118-H1*b*, 118-H2*a*, and 118-H2*b*), a front face V that includes six microphones (e.g., microphones 118-V1*a*, 118-V1*b*, 118-V2*a*, 118-V2*b*, 118-V3*a*, and 118-V3*b*), and a side face U that includes six microphones (e.g., microphones 118-U1*a*, 118-U1*b*, 118-U2*a*, 118-U2*b*, 118-U3*a*, and 118-U3*b*).

While FIG. 7A illustrates the top face H as having fewer microphones 118 than the front face V and the side face U, the disclosure is not limited thereto and the number of microphones 118 included in the top face H may vary without departing from the disclosure. For example, the top face H may include the same number of microphones 118 and/or more microphones 118 than the front face V and/or the side face U without departing from the disclosure. Similarly, while FIG. 7A illustrates the front face V as including the same number of microphones 118 as the side face U, the disclosure is not limited thereto and the number of microphones 118 included in the front face V may vary with respect to the number of microphones included in the side face U without departing from the disclosure.

By including microphones 118 on different faces of a 3D object, such as a cube, the microphone array may simplify beamforming in three dimensions. For example, the device 102 may replace complex three-dimensional (3D) calculations with simpler two-dimensional (2D) calculations, such as determining two-dimensional directions (e.g., vectors having two coordinates) and using a fixed constant value for the third dimension. Thus, the device 102 may simplify calculations associated with determining a direction of each beam when performing a beamforming operation. The simplified calculations may result in improved performance and/or decreased processing load on the device 102.

To illustrate examples, FIG. 7B illustrates beamforming directions relative to the top face H, the front face V and the side face U. As illustrated in FIG. 7B, the top face H is a first plane extending along the x-axis and the y-axis (e.g., extending in a first dimension and a second dimension). Thus, beamforming performed using microphones 118 included in the top face H (e.g., microphones 118 located on or positioned along the first plane) results in first beams that correspond to two dimensional directions along an x-y plane, with a fixed constant value (e.g., zero for simplified 2D calculations, or a z-coordinate associated with the top face H for 3D calculations) along the z-axis. Therefore, the device 102 may easily calculate directions associated with the first beams as the directions are parallel to the top face H.

Similarly, the front face V is a second plane extending along the y-axis and the z-axis (e.g., extending in the second dimension and a third dimension). Thus, beamforming performed using microphones 118 included in the front face V (e.g., microphones 118 located on or positioned along the second plane) results in second beams that correspond to two dimensional directions along a y-z plane, with a fixed constant value (e.g., zero for simplified 2D calculations, or a y-coordinate associated with the front face V for 3D calculations) along the x-axis. Thus, the device 102 may easily calculate directions associated with the second beams as the directions are parallel to the front face V.

Finally, the side face U is a third plane extending along the x-axis and the z-axis (e.g., extending in the first dimension and the third dimension). Thus, beamforming performed using microphones 118 included in the side face U (e.g., microphones 118 located on or positioned along the third plane) results in third beams that correspond to two dimensional directions along an x-z plane, with a fixed constant value (e.g., zero for simplified 2D calculations, or a y-coordinate associated with the side face U for 3D calculations) along the y-axis. Thus, the device 102 may easily calculate directions associated with the third beams as the directions are parallel to the side face U.

While the device 102 may select subsets of the microphone array to reduce complex 3D calculations to simpler 2D calculations, the disclosure is not limited thereto. Instead, the device 102 may select subset(s) of the microphone array and still perform complex 3D calculations without departing from the disclosure. Additionally or alternatively, while the examples described above illustrate the device 102 selecting subsets of the three-dimensional microphone array on which to perform beamforming, the disclosure is not limited thereto and the device 102 may use an entirety of the three-dimensional microphone array to perform beamforming without departing from the disclosure.

Figure 8:
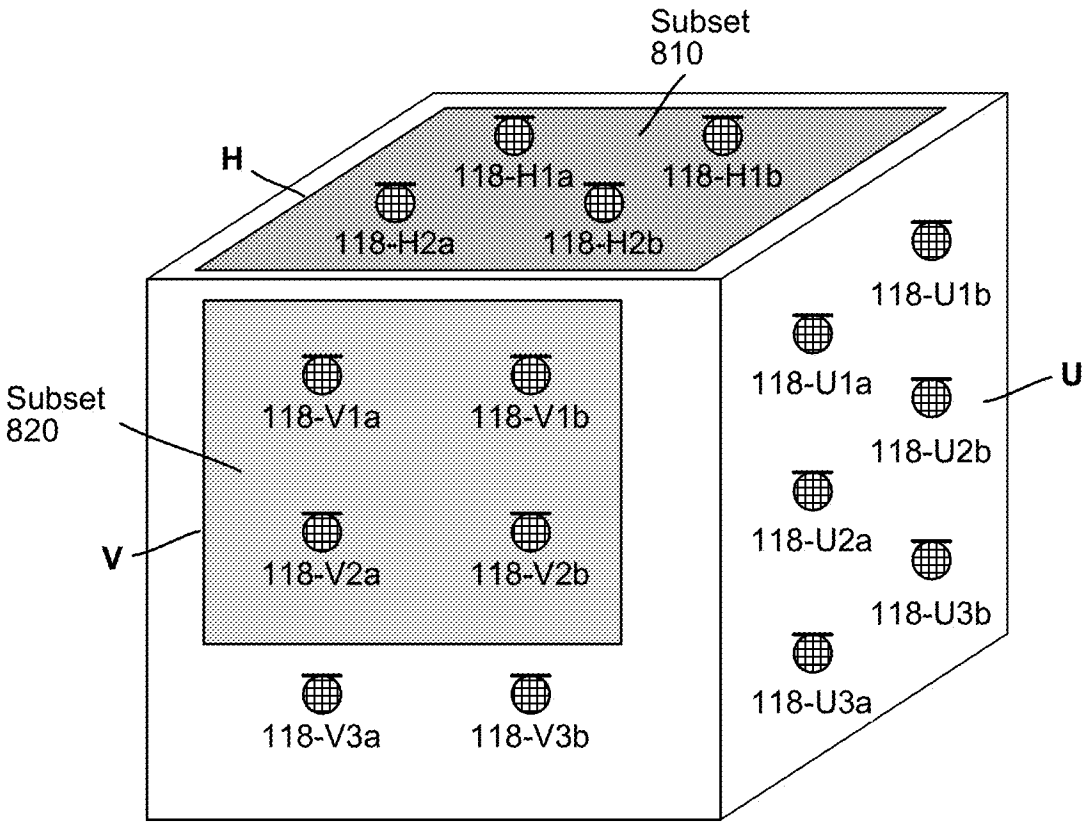
FIG. 8 illustrates an example of performing beamforming using subsets of a three-dimensional microphone array according to embodiments of the present disclosure.

FIG. 8 illustrates an example of performing beamforming using subsets of a three-dimensional microphone array according to embodiments of the present disclosure. As illustrated in FIG. 8, the device 102 may select a first subset 810 (e.g., target subset) along the top face H and a second subset 820 (e.g., reference subset) along the front face V. The first subset 810 includes all of the microphones 118 along the top face H, although the disclosure is not limited thereto and the first subset 810 may include only some of the microphones 118 without departing from the disclosure. In contrast, the second subset 820 includes only a portion of the microphones 118 along the front face V, although the disclosure is not limited thereto and the second subset 820 may include all of the microphones 118 along the front face V without departing from the disclosure.

Additionally or alternatively, the device 102 may select microphones 118 along different faces as part of a single subset. For example, while FIG. 8 illustrates the first subset 810 only including microphones 118 along the top face H, the first subset 810 may include microphones 118 along the front face V and/or the side face U without departing from the disclosure. Similarly, while FIG. 8 illustrates the second subset 820 only including microphones 118 along the front face V, the second subset 820 may include microphones 118 along the top face H and/or the side face U without departing from the disclosure.

To illustrate an example, the device 102 may determine that a user is located above the device 102 such that speech input is received at a top (e.g., the top face H) of the device 102. In contrast, the device 102 may determine that a loudspeaker 114 is located to the side of the device 102 such that audible sound output by the loudspeaker 114 is received by a side (e.g., the front face V) of the device 102. Thus, the device 102 may select the first subset 810 along the top face H, may generate first beams using the first subset 810, and may select one or more of the first beams as target signal(s). Similarly, the device 102 may select the second subset 820 along the front face V, may generate second beams using the second subset 820, and may select one or more of the second beams as reference signal(s). After performing acoustic echo cancellation to remove the reference signal(s) from the target signal(s), the device 102 may output isolated audio data 126 that includes only the speech input.

In addition to or as an alternative to selecting a subset of the microphone array to generate reference signals, the device 102 may also include directional microphones that are targeted at source(s) of noise and/or remote microphones that are in proximity to a source of noise. Thus, if the device 102 is in a fixed configuration relative to a source of noise (e.g., loudspeakers 114, engine, motor, mechanical device, etc.), the device 102 may include one or more directional microphones that may be aimed at the source of noise to remove interference caused by the source of noise.

Additionally or alternatively, the device 102 may receive audio data generated by a remote microphone that is located in proximity to the source of noise. In some examples, the remote microphone may not only be in proximity to the source of noise, but may be positioned such that the remote microphone only captures first audio generated by the source of noise and attenuated second audio from other sources. For example, if the source of noise is an engine in a car, the remote microphone may be located under the hood in the engine compartment, such that the remote microphone detects audio generated by the engine but the engine compartment attenuates audio corresponding to the speech input. Similarly, if the source of noise is a motor in a boat, the remote microphone may be located in the motor housing, such that the remote microphone detects audio generated by the motor but the motor housing attenuates audio corresponding to the speech input. Finally, if the source of noise is a loudspeaker 114, the remote microphone may be located in a housing of the loudspeaker 114, such that the remote microphone detects audio generated by the loudspeaker but the loudspeaker housing attenuates audio corresponding to the speech input.

Figure 9A:
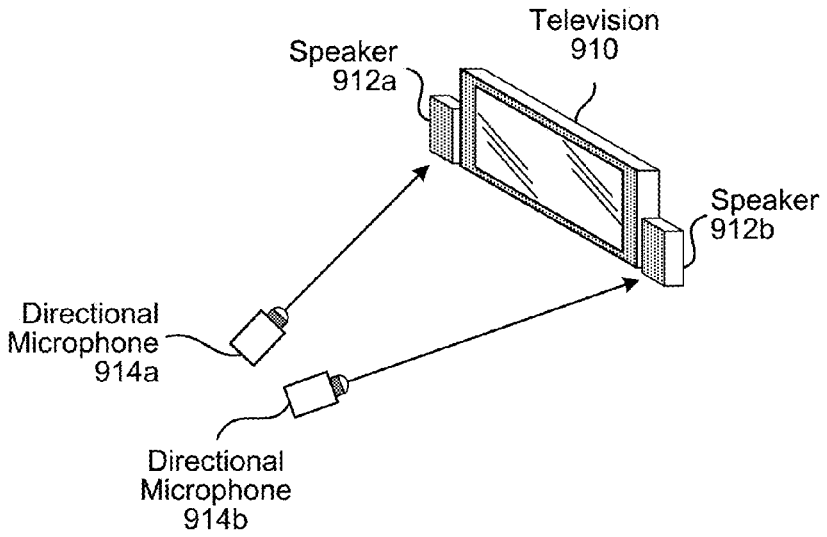
FIGS. 9A-9C illustrate examples of using directional microphones and remote microphones to improve the reference signals according to embodiments of the present disclosure.
Figure 9B:
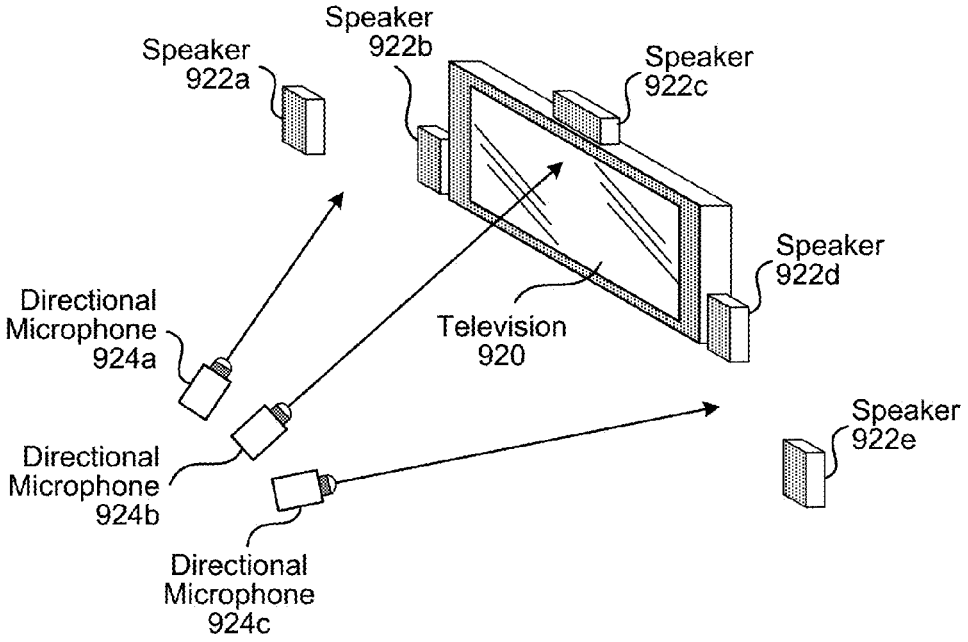
Figure 9C:
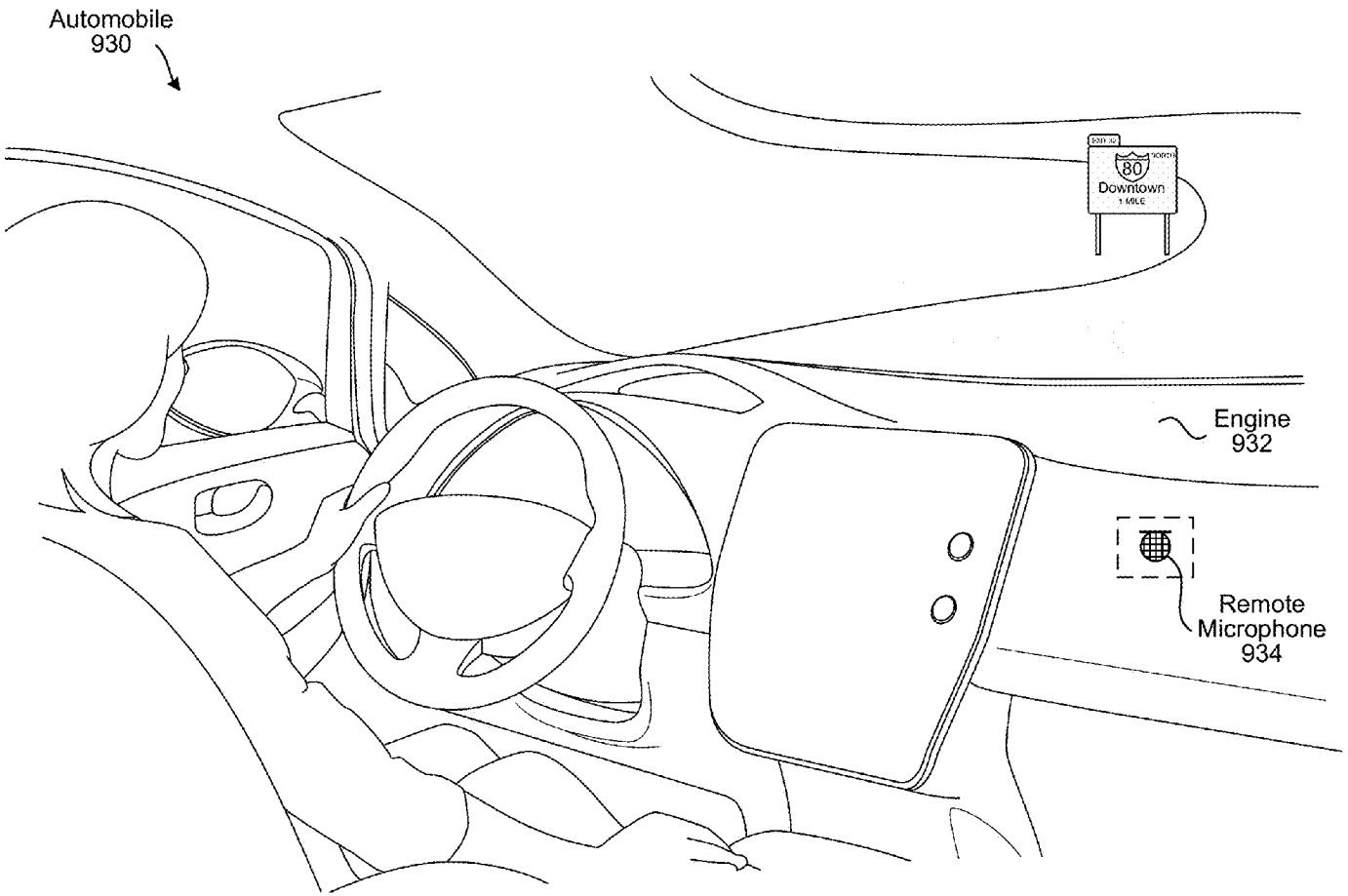

FIGS. 9A-9C illustrate examples of using directional microphones and remote microphones to improve the reference signals according to embodiments of the present disclosure. As illustrated in FIG. 9A, a television 910 may be coupled to a first speaker 912*a* and a second speaker 912*b*, which may output stereo audio. In some examples, the device 102 may select a subset of a microphone array (e.g., group of microphones) based on proximity to the speakers 912, may perform beamforming using the subset and/or may select beams as reference signals based on a direction of the speakers 912. As illustrated in FIG. 9A, the device 102 may additionally or alternatively include a first directional microphone 914*a* aimed at the first speaker 912*a* and a second directional microphone 914*b* aimed at the second speaker 912*b*. Thus, the device 102 may generate directional audio data using the directional microphones 914 and may use the directional audio data as reference signals. In some examples, the device 102 may use the directional audio data in addition to the beams selected as reference signals to perform acoustic echo cancellation. However, the disclosure is not limited thereto and the device 102 may use only the directional audio data as the reference signals without departing from the disclosure.

As illustrated in FIG. 9B, a television 920 may be coupled to a speaker system capable of 5.1 surround sound. For example, the television 920 may be coupled to a first speaker 922*a* (e.g., Left Surround), a second speaker 922*b* (e.g., Left Front), a third speaker 922*c* (e.g., Center), a fourth speaker 922*d* (e.g., Right Front), and/or a fifth speaker 922*e* (e.g., Right Surround). As mentioned above, in some examples the device 102 may select a subset of a microphone array based on proximity to the speakers 922, may perform beamforming using the subset and/or may select beams as reference signals based on a direction of the speakers 922. As illustrated in FIG. 9B, the device 102 may additionally or alternatively include a first directional microphone 924*a* aimed at the first speaker 922*a* and the second speaker 922*b*, a second directional microphone 924*b* aimed at the third speaker 922*c*, and a third directional microphone 924*c* aimed at the fourth speaker 922*d* and the fifth speaker 922*e*. Thus, the device 102 may generate directional audio data using the directional microphones 924 and may use the directional audio data as reference signals. In some examples, the device 102 may use the directional audio data in addition to the beams selected as reference signals to perform acoustic echo cancellation. However, the disclosure is not limited thereto and the device 102 may use only the directional audio data as the reference signals without departing from the disclosure.

In some examples, the device 102 may automatically direct a directional microphone towards a source of noise. For example, the device 102 may position itself, a microphone array and/or individual directional microphones for optimal acoustic echo cancellation (AEC). As a first example, the device 102 may include mechanical components that enable the device 102 to position itself in a desired direction and/or configuration. For example, the device 102 may rotate/move towards and/or away from a speech source (e.g., a person talking) to improve target signals prior to AEC. Additionally or alternatively, the device 102 may rotate/move towards and/or away from a noise source in order to improve reference signals used for AEC. In some examples, the device 102 may include fixed directional microphone(s) and the device 102 may position itself such that the fixed directional microphone(s) are pointed at the speech source and/or noise source. While the above examples illustrate the device 102 automatically moving itself to improve AEC, the disclosure is not limited thereto and the device 102 may instead output information to a user (e.g., generate audio data or display data and/or send a message to the user) that indicates how/where to move the device 102 to improve AEC.

As a second example, the device 102 may include mechanical components that enable the device 102 to position a microphone array and/or directional microphone(s) to improve AEC. For example, the microphone array may include fixed directional microphone(s) and the device 102 may rotate the microphone array using motors or the like. Additionally or alternatively, the device 102 may individually aim directional microphone(s) using motors or the like without departing from the disclosure. As discussed above, however, the disclosure is not limited thereto and the device 102 may output information to the user that indicates how/where to move the microphone array and/or directional microphone(s) to improve AEC.

In addition to or as an alternative to including directional microphones, the device 102 may be configured to receive audio data from remote microphones to improve AEC. Remote microphone(s) may be located remotely from the device 102 but proximate to a source of noise, such as mechanical devices (e.g., engine in an automobile, motor in a boat, etc.), electronic devices (e.g., loudspeaker, video game console, television, etc.), appliances (e.g., air conditioner, refrigerator, etc.), environmental noise that can be isolated (e.g., road noise for an automobile, street noise or construction noise outside a window, etc.), and/or the like. In some examples, the remote microphone(s) may be preinstalled in an enclosure, such as during manufacturing. For example, a remote microphone may be installed within an enclosure (e.g., housing), of a boat motor, a loudspeaker, a video game console, appliance(s) or the like. In other examples, the remote microphone(s) may correspond to external microphones that are placed in proximity to a source of noise by the user to improve AEC. For example, a remote microphone may be placed in or near an engine compartment of a car, a motor of a boat, electronic device(s), appliance(s), windows, or the like.

The remote microphone(s) may send audio data to the device 102 using wired and/or wireless connections. As a first example, a first remote microphone may be installed in an enclosure associated with a source of noise and may include a wire to connect to the device 102 (e.g., remote microphone associated with the source of noise). As a second example, a second remote microphone may be associated with the device 102 and may be placed up to a first distance from the device 102 (e.g., the device 102 includes a remote microphone with a length of wire along with instructions to place the remote microphone as close to a source of noise as possible). Additionally or alternatively, the first remote microphone and/or the second remote microphone may directly communicate with the device 102 using wireless signals (e.g., via infrared (IR) signals, Bluetooth or the like) or may indirectly communicate with the device 102 using wireless signals (e.g., via a wireless network). For example, an appliance may be a smart device (e.g., including a processor and capable of connecting to a wireless network) and may be configured to capture audio data using a microphone attached to the appliance and send the audio data to the device 102.

As illustrated in FIG. 9C, an automobile 930 may include an engine 932 that may emit noise. The device 102 may receive remote audio data from a remote microphone 934 that is in proximity to the engine 932, such as by being located in the engine compartment. Thus, the device 102 may generate omnidirectional remote audio data using the remote microphones 934 and may use the omnidirectional remote audio data as a reference signal. In some examples, the device 102 may use the remote audio data in addition to the beams selected as reference signals to perform acoustic echo cancellation. However, the disclosure is not limited thereto and the device 102 may use only the remote audio data as the reference signal without departing from the disclosure.

While FIGS. 9A-9C illustrate examples of using directional microphone(s) and/or remote microphone(s) to generate reference signals, the disclosure is not limited thereto. Instead, the device 102 may use directional microphone(s) and/or remote microphone(s) to generate target signals without departing from the disclosure. For example, directional microphone(s) may be aimed at and/or remote microphone(s) may be installed in or positioned near a specific location that is associated with a source of speech (e.g., driver's seat in a car, pulpit in a church, lectern in a lecture hall, desk in an office, table in a kitchen, couch or chair in a living room, etc.). Thus, the device 102 may improve an output of the AEC by including audio data generated by the directional microphone(s) and/or the remote microphone(s) as target signal(s) (e.g., target data).

Figure 10:
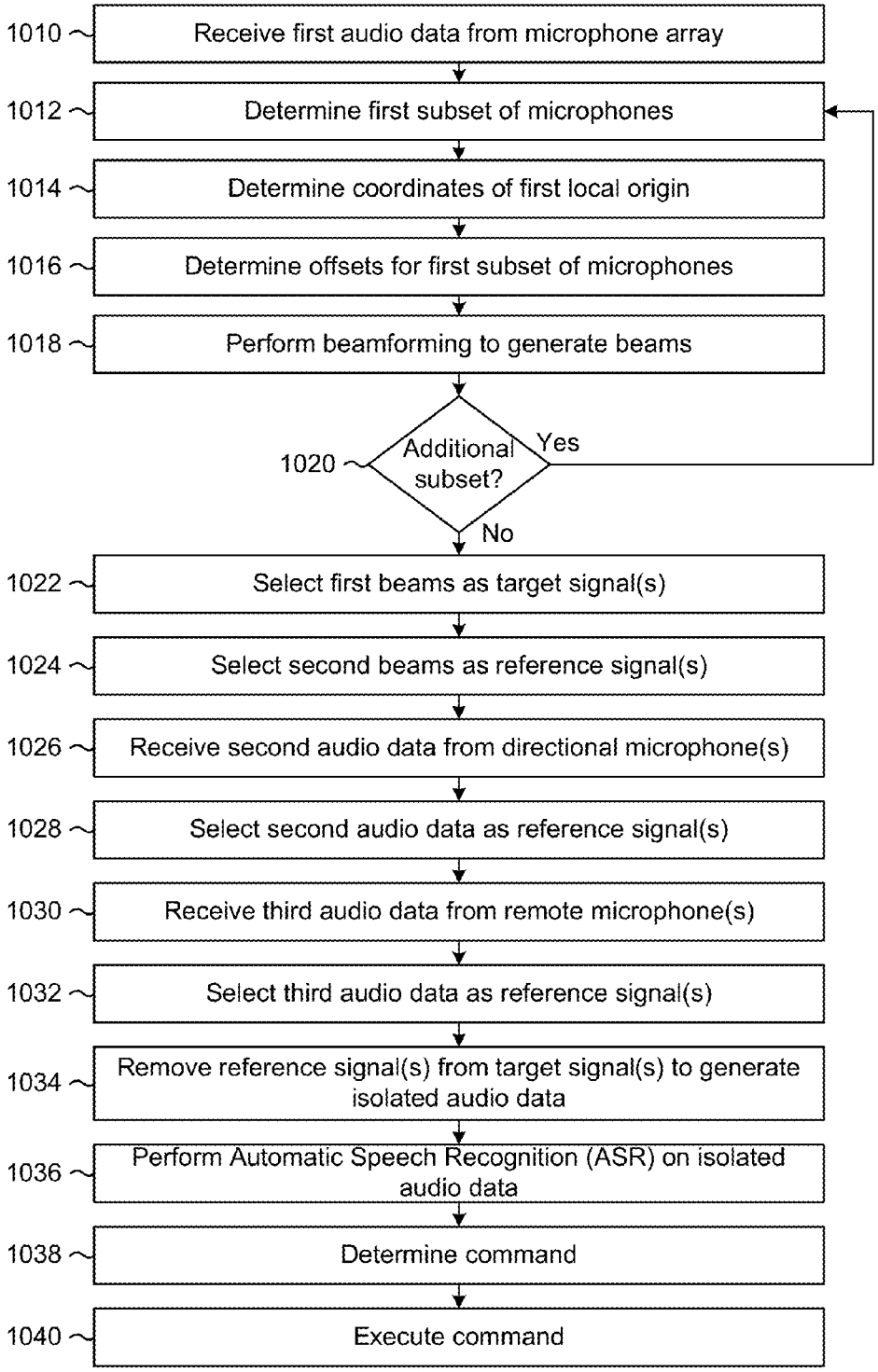
FIG. 10 is a flowchart conceptually illustrating an example method for performing adaptive beamforming using subset(s) of a microphone array according to embodiments of the present disclosure.

FIG. 10 is a flowchart conceptually illustrating an example method for performing adaptive beamforming using subset(s) of a microphone array according to embodiments of the present disclosure. As illustrated in FIG. 10, the device 102 may receive (1010) first audio data from a microphone array and may determine (1012) a first subset of microphones in the microphone array. The device 102 may determine (1014) coordinates of a first local origin (e.g., center of the first subset of microphones), determine (1016) offsets for each of the first subset of microphones (e.g., individual offset indicating a position of an individual microphone relative to the first local origin) and may perform (1018) beamforming (e.g., a beamforming operation) to generate beams (e.g., beamformed audio signals) using a portion of the first audio data that corresponds to the first subset of microphones.

The first local origin may be referred to as a first reference location, first local coordinates or the like without departing from the disclosure. The first local origin may be associated with a center of the first subset of microphones, such that the beams are centered on the first local origin (e.g., a first beam corresponds to first audio data associated with a first direction relative to the first local origin, a second beam corresponds to second audio data associated with a second direction relative to the first local origin, etc.). However, the disclosure is not limited thereto and the first local origin can be positioned anywhere relative to the first subset of microphones. For example, the first local origin may be associated with a first position of a first microphone in the first subset of microphones, and each microphone of the first subset of microphones may be associated with an individual offset (e.g., a second microphone may be associated with an offset that indicates a second position of the second microphone relative to the first position). Thus, the device 102 may determine relative positions of the first subset of microphones and perform a beamforming operation based on the relative positions.

The device 102 may determine (1020) whether there is an additional subset of microphones and, if so, may loop to step 1012 to repeat steps 1012-1020. If there is not an additional subset of microphones, the device 102 may select (1022) first beams as target signal(s) and may select (1024) second beams as reference signal(s).

In some examples, the device 102 may receive (1026) second audio data from one or more directional microphone(s) and select (1028) the second audio data as being included in the reference signal(s). Additionally or alternatively, the device 102 may receive (1030) third audio data from one or more remote microphone(s) and may select (1032) the third audio data as being included in the reference signal(s).

The device 102 may remove (1034) the reference signal(s) from the target signal(s) to generate isolated audio data. The system 100 may perform (1036) automatic speech recognition (ASR) on the isolated audio data to generate text, may determine (1038) a command from the text and may execute (1040) the command. In some examples, the device 102 may be capable of performing ASR processing on the isolated audio data. However, the disclosure is not limited thereto and in other examples, the device 102 may output the isolated audio data to a remote device (e.g., remote server(s)) and may receive an instruction to execute the command from the remote device.

Figure 11:
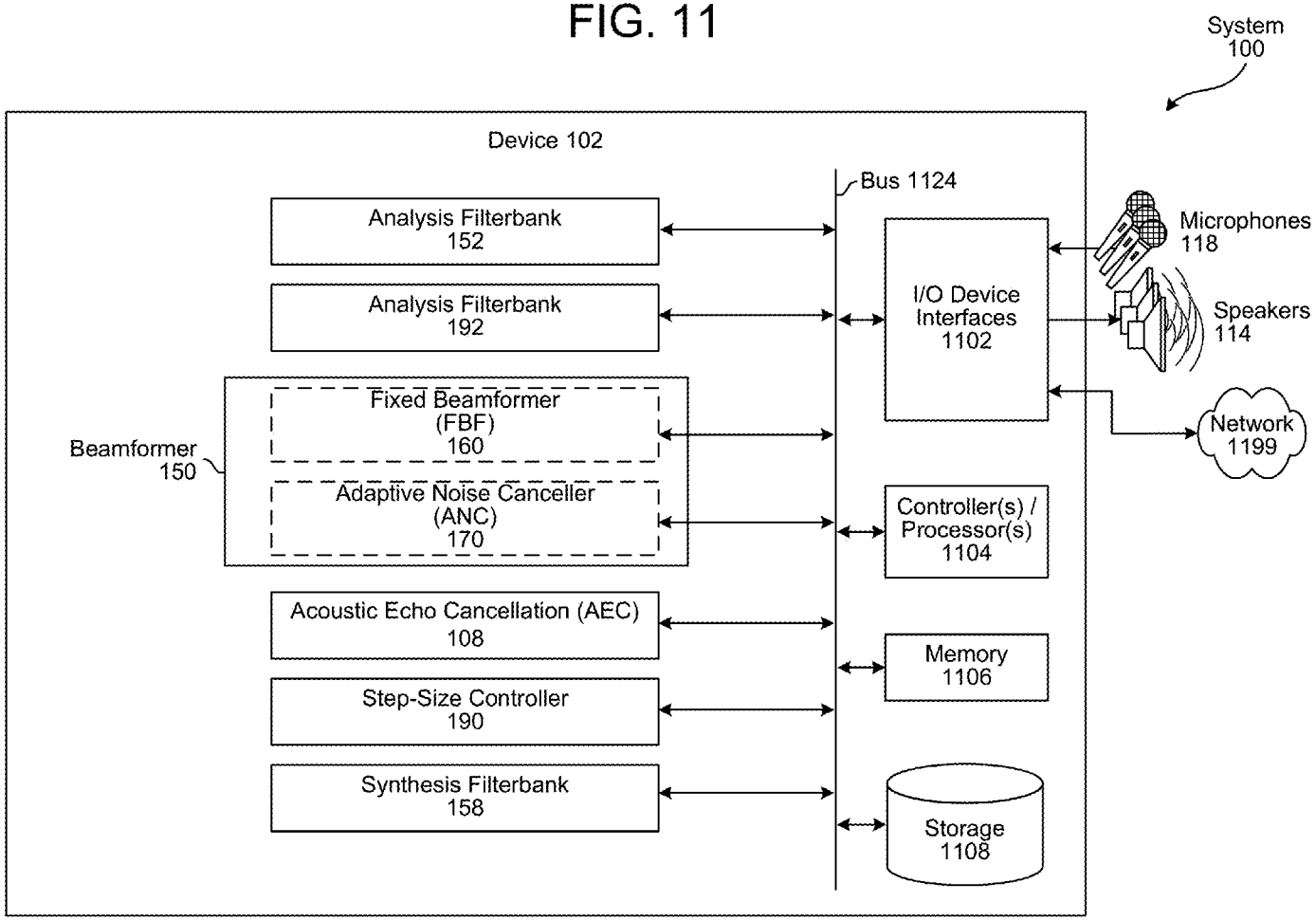
FIG. 11 is a block diagram conceptually illustrating example components of a system for acoustic interference cancellation according to embodiments of the present disclosure.

FIG. 11 is a block diagram conceptually illustrating example components of the system 100. In operation, the system 100 may include computer-readable and computer-executable instructions that reside on the device 102, as will be discussed further below.

The system 100 may include one or more audio capture device(s), such as a microphone 118 or an array of microphones 118. The audio capture device(s) may be integrated into the device 102 or may be separate.

The system 100 may also include an audio output device for producing sound, such as loudspeaker(s) 114. The audio output device may be integrated into the device 102 or may be separate.

The device 102 may include an address/data bus 1124 for conveying data among components of the device 102. Each component within the device 102 may also be directly connected to other components in addition to (or instead of) being connected to other components across the bus 1124.

The device 102 may include one or more controllers/processors 1104, which may each include a central processing unit (CPU) for processing data and computer-readable instructions, and a memory 1106 for storing data and instructions. The memory 1106 may include volatile random access memory (RAM), non-volatile read only memory (ROM), non-volatile magnetoresistive (MRAM) and/or other types of memory. The device 102 may also include a data storage component 1108, for storing data and controller/processor-executable instructions. The data storage component 1108 may include one or more non-volatile storage types such as magnetic storage, optical storage, solid-state storage, etc.

The device 102 may also be connected to removable or external non-volatile memory and/or storage (such as a removable memory card, memory key drive, networked storage, etc.) through the input/output device interfaces 1102.

Computer instructions for operating the device 102 and its various components may be executed by the controller(s)/processor(s) 1104, using the memory 1106 as temporary "working" storage at runtime. The computer instructions may be stored in a non-transitory manner in non-volatile memory 1106, storage 1108, or an external device. Alternatively, some or all of the executable instructions may be embedded in hardware or firmware in addition to or instead of software.

The device 102 includes input/output device interfaces 1102. A variety of components may be connected through the input/output device interfaces 1102, such as the loudspeaker(s) 114, the microphones 118, and a media source such as a digital media player (not illustrated). The input/output interfaces 1102 may include A/D converters for converting the output of microphone 118 into echo signals y 120, if the microphones 118 are integrated with or hardwired directly to device 102. If the microphones 118 are independent, the A/D converters will be included with the microphones 118, and may be clocked independent of the clocking of the device 102. Likewise, the input/output interfaces 1102 may include D/A converters for converting the reference signals x 112 into an analog current to drive the loudspeakers 114, if the loudspeakers 114 are integrated with or hardwired to the device 102. However, if the loudspeakers 114 are independent, the D/A converters will be included with the loudspeakers 114, and may be clocked independent of the clocking of the device 102 (e.g., conventional Bluetooth loudspeakers).

The input/output device interfaces 1102 may also include an interface for an external peripheral device connection such as universal serial bus (USB), FireWire, Thunderbolt or other connection protocol. The input/output device interfaces 1102 may also include a connection to one or more networks 1199 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. Through the network 1199, the system 100 may be distributed across a networked environment.

The device 102 further includes an analysis filterbank 152, an analysis filterbank 192, at least one beamformer 150, at least one acoustic echo cancellation (AEC) 108, a step-size controller 190 and a synthesis filter bank 158. Each beamformer 150 may optionally include a fixed beamformer (FBF) 160 and an adaptive noise canceller (ANC) 170.

Multiple devices 102 may be employed in a single system 100. In such a multi-device system, each of the devices 102 may include different components for performing different aspects of the AEC process. The multiple devices may include overlapping components. The components of device 102 as illustrated in FIG. 11 is exemplary, and may be a stand-alone device or may be included, in whole or in part, as a component of a larger device or system. For example, in certain system configurations, one device may transmit and receive the audio data, another device may perform AEC, and yet another device my use the isolated audio data 126 for operations such as speech recognition.

The concepts disclosed herein may be applied within a number of different devices and computer systems, including, for example, general-purpose computing systems, multimedia set-top boxes, televisions, stereos, radios, server-client computing systems, telephone computing systems, laptop computers, cellular phones, personal digital assistants (PDAs), tablet computers, wearable computing devices (watches, glasses, etc.), other mobile devices, etc.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of digital signal processing and echo cancellation should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the MC-AECs 108 may be implemented by a digital signal processor (DSP).

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, comprising:

outputting, via a first loudspeaker, audible sound corresponding to first audio data;

receiving, from a microphone array, second audio data representing the audible sound and a speech input from a speech source;

selecting a first group of microphones of the microphone array, wherein the first group of microphones face the speech source;

selecting a first portion of the second audio data, the first portion corresponding to data generated by the first group of microphones;

performing a first beamforming operation using the first portion of the second audio data to generate:

first beamformed audio data that corresponds to a first direction relative to the first group of microphones, and second beamformed audio data that corresponds to a second direction relative to the first group of microphones;

selecting a second group of microphones of the microphone array, wherein the second group of microphones face the first loudspeaker;

selecting a second portion of the second audio data, the second portion corresponding to data generated by the second group of microphones;

performing a second beamforming operation using the second portion of the second audio data to generate:

third beamformed audio data that corresponds to a third direction relative to the second group of microphones, and fourth beamformed audio data that corresponds to a fourth direction relative to the second group of microphones;

determining that the speech source is located within the first direction relative to the first group of microphones;

determining that the loudspeaker is located within the third direction relative to the second group of microphones; and subtracting the third beamformed data from the first beamformed data to generate third audio data including a representation of the speech input.

2. The computer-implemented method of claim 1, further comprising:

determining a first location corresponding to the first group of microphones;

determining, for a first microphone in the first group of microphones, a first position relative to the first location;

determining a second location corresponding to the second group of microphones;

determining, for a second microphone in the second subset, a second position relative to the second location, wherein:

the first beamforming operation uses the first location, and the second beamforming operation uses the second location.

3. The computer-implemented method of claim 1, wherein:

the microphone array comprises a three-dimensional array of microphones in a cube arrangement;

selecting the first group of microphones further comprises identifying that the first group of microphones are positioned along a first plane of the cube arrangement; and selecting the second group of microphones further comprises identifying that the second group of microphones are positioned along a second plane of the cube arrangement.

4. The computer-implemented method of claim 1, further comprising:

receiving, from a directional microphone directed at the first loudspeaker, fourth audio data including a first representation of the audible sound;

receiving, from a remote microphone located in proximity to a source of noise, fifth audio data including a second representation of second audible sound generated by the source of noise; and subtracting the third beamformed data, the fourth audio data and the fifth audio data from the first beamformed data to generate the third audio data.

5. A computer-implemented method, comprising:

sending, to a first loudspeaker, first audio data;

receiving, from a microphone array, second audio data representing speech input from a speech source and audible sound output by the first loudspeaker;

selecting a first group of microphones of the microphone array;

determining a first portion of the second audio data corresponding to the first group of microphones;

determining, using the first portion of the second audio data, first beamformed audio data corresponding to a first direction and second beamformed audio data corresponding to a second direction;

selecting a second group of microphones of the microphone array, the second group of microphones different than the first group of microphones;

determining a second portion of the second audio data corresponding to the second group of microphones;

determining, using the second portion of the second audio data, third beamformed audio data corresponding to a third direction and fourth beamformed audio data corresponding to a fourth direction;

determining target data that includes at least the first beamformed audio data;

determining reference data that includes at least the third beamformed audio data; and subtracting the reference data from the target data to generate third audio data.

6. The computer-implemented method of claim 5, further comprising:

determining a first location corresponding to the first group of microphones;

determining, for a first microphone in the first group of microphones, a first position relative to the first location;

determining a second location corresponding to the second group of microphones;

determining, for a second microphone in the second subset, a second position relative to the second location, wherein:

the first beamformed audio data and the second beamformed audio data are determined based on the first location, and the third beamformed audio data and the fourth beamformed audio data are determined based on the second location.

7. The computer-implemented method of claim 5, further comprising:

selecting a third group of microphones of the microphone array, the third group of microphones different from the first group of microphones and different from the second group of microphones;

determining a third portion of the second audio data corresponding to the third group of microphones;

determining, using the third portion of the second audio data, fifth beamformed audio data corresponding to a fifth direction;

selecting a fourth group of microphones of the microphone array, the fourth group of microphones different than the third group of microphones;

determining a fourth portion of the second audio data corresponding to the fourth group of microphones;

determining, using the fourth portion of the second audio data, sixth beamformed audio data corresponding to a sixth direction;

selecting at least the first beamformed audio data and the fifth beamformed audio data as the target data; and selecting at least the third beamformed audio data and the sixth beamformed audio data as the reference data.

8. The computer-implemented method of claim 5, further comprising:

determining, based on the first portion of the second audio data, fifth beamformed audio data corresponding to a fifth direction that is opposite the first direction;

determining, based on the first portion of the second audio data, sixth beamformed audio data corresponding to a sixth direction that is perpendicular to the first direction; and determining that the target data includes at least the first beamformed audio data but does not include at least one of the fifth beamformed audio data or the sixth beamformed audio data.

9. The computer-implemented method of claim 5, wherein:

the microphone array comprises a three-dimensional array of microphones in a cube arrangement;

the first group of microphones are positioned along a first plane of the cube arrangement; and the second group of microphones are positioned along a second plane of the cube arrangement.

10. The computer-implemented method of claim 9, wherein:

determining the target data further comprises:

selecting a first plurality of beamformed audio signals as the target data, the first plurality of beamformed audio signals corresponding to first vectors that have the first constant value in the third dimension, the first plurality of beamformed audio signals including at least the first beamformed audio data, and determining the reference data further comprises:

selecting a second plurality of beamformed audio signals as the reference data, the second plurality of beamformed audio signals corresponding to second vectors that have the second constant value in the first dimension, the second plurality of beamformed audio signals including at least the third beamformed audio data.

11. The computer-implemented method of claim 5, further comprising:

receiving, from a directional microphone directed at one or more loudspeakers, fourth audio data representing second audible sound output by the one or more loudspeakers; and selecting at least the third beamformed audio data and the fourth audio data as the reference data.

12. The computer-implemented method of claim 5, further comprising:

receiving, from a remote microphone located in proximity to a source of noise, fourth audio data representing second audible sound generated by the source of noise; and selecting at least the third beamformed audio data and the fourth audio data as the reference data.

13. A first device, comprising:

at least one processor;

a wireless transceiver; and a memory device including first instructions operable to be executed by the at least one processor to configure the first device to:

send, to a first loudspeaker, first audio data;

receive, from a microphone array, second audio data representing speech input from a speech source and audible sound output by the first loudspeaker;

select a first group of microphones of the microphone array;

determine a first portion of the second audio data corresponding to the first group of microphones;

determine, using the first portion of the second audio data, first beamformed audio data corresponding to a first direction and second beamformed audio data corresponding to a second direction;

select a second group of microphones of the microphone array, the second group of microphones different than the first group of microphones;

determine a second portion of the second audio data corresponding to the second group of microphones;

determine, using the second portion of the second audio data, third beamformed audio data corresponding to a third direction and fourth beamformed audio data corresponding to a fourth direction;

determine target data that includes at least the first beamformed audio data;

determine reference data that includes at least the third beamformed audio data; and subtract the reference data from the target data to generate third audio data.

14. The first device of claim 13, wherein the first instructions further configure the first device to:

determine a first location corresponding to the first group of microphones;

determine, for a first microphone in the first group of microphones, a first position relative to the first location;

determine a second location corresponding to the second group of microphones;

determine, for a second microphone in the second subset, a second position relative to the second location, wherein:

the first beamformed audio data and the second beamformed audio data are determined based on the first location, and the third beamformed audio data and the fourth beamformed audio data are determined based on the second location.

15. The first device of claim 13, wherein the first instructions further configure the first device to:

select a third group of microphones of the microphone array, the third group of microphones different from the first group of microphones and different from the second group of microphones;

determine a third portion of the second audio data corresponding to the third group of microphones;

determine, using the third portion of the second audio data, fifth beamformed audio data corresponding to a fifth direction;

select a fourth group of microphones of the microphone array, the fourth group of microphones different than the third group of microphones;

determine a fourth portion of the second audio data corresponding to the fourth group of microphones;

determine, using the fourth portion of the second audio data, sixth beamformed audio data corresponding to a sixth direction;

select at least the first beamformed audio data and the fifth beamformed audio data as the target data; and select at least the third beamformed audio data and the sixth beamformed audio data as the reference data.

16. The first device of claim 13, wherein the first instructions further configure the first device to:

determine, based on the first portion of the second audio data, fifth beamformed audio data corresponding to a fifth direction that is opposite the first direction;

determine, based on the first portion of the second audio data, sixth beamformed audio data corresponding to a sixth direction that is perpendicular to the first direction; and determine that the target data includes at least the first beamformed audio data but does not include at least one of the fifth beamformed audio data or the sixth beamformed audio data.

17. The first device of claim 13, wherein:

the microphone array comprises a three-dimensional array of microphones in a cube arrangement;

the first group of microphones are positioned along a first plane of the cube arrangement; and the second group of microphones are positioned along a second plane of the cube arrangement.

18. The first device of claim 17, wherein the first instructions further configure the first device to:

select a first plurality of beamformed audio signals as the target data, the first plurality of beamformed audio signals corresponding to first vectors that have the first constant value in the third dimension, the first plurality of beamformed audio signals including at least the first beamformed audio data; and select a second plurality of beamformed audio signals as the reference data, the second plurality of beamformed audio signals corresponding to second vectors that have the second constant value in the first dimension, the second plurality of beamformed audio signals including at least the third beamformed audio data.

19. The first device of claim 13, wherein the first instructions further configure the first device to:

receive, from a directional microphone directed at one or more loudspeakers, fourth audio data representing second audible sound output by the one or more loudspeakers; and select at least the third beamformed audio data and the fourth audio data as the reference data.

20. The first device of claim 13, wherein the first instructions further configure the first device to:

receive, from a remote microphone located in proximity to a source of noise, fourth audio data representing second audible sound generated by the source of noise; and select at least the third beamformed audio data and the fourth audio data as the reference data.

* * * * *